US009213271B2

(12) United States Patent
Wada et al.

(10) Patent No.: US 9,213,271 B2
(45) Date of Patent: Dec. 15, 2015

(54) CLEANER, AND IMAGE FORMING APPARATUS USING THE CLEANER

(71) Applicants: Yuuji Wada, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Yusuke Mitani, Kanagawa (JP); Kazuki Yogosawa, Tokyo (JP)

(72) Inventors: Yuuji Wada, Kanagawa (JP); Kenji Sugiura, Kanagawa (JP); Naohiro Kumagai, Kanagawa (JP); Seiichi Kogure, Kanagawa (JP); Junpei Fujita, Kanagawa (JP); Yusuke Mitani, Kanagawa (JP); Kazuki Yogosawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/541,279

(22) Filed: Nov. 14, 2014

(65) Prior Publication Data

US 2015/0147074 A1 May 28, 2015

(30) Foreign Application Priority Data

Nov. 26, 2013 (JP) ..... 2013-244259

(51) Int. Cl.

| | |
|---|---|
| ***G03G 21/10*** | (2006.01) |
| ***G03G 15/16*** | (2006.01) |
| *G03G 15/00* | (2006.01) |
| *G03G 21/00* | (2006.01) |

(52) U.S. Cl.

CPC ..... *G03G 15/161* (2013.01); *G03G 21/007* (2013.01); *G03G 21/0047* (2013.01); *G03G 15/70* (2013.01); *G03G 21/0035* (2013.01); *G03G 21/0076* (2013.01); *G03G 2215/1661* (2013.01)

(58) Field of Classification Search

CPC ... G03G 21/00; G03G 21/10; G03G 21/0035; G03G 21/0047; G03G 21/007; G03G 21/0076; G03G 15/161; G03G 15/70; G03G 2215/1661

See application file for complete search history.

(56) References Cited

U.S. PATENT DOCUMENTS

| | | | | |
|---|---|---|---|---|
| 5,600,405 A * | 2/1997 | Umeda et al. | ..... | 399/71 |
| 7,251,430 B2 * | 7/2007 | Nishikawa | ..... | G03G 15/168 399/101 |

(Continued)

FOREIGN PATENT DOCUMENTS

| | | | | |
|---|---|---|---|---|
| JP | 2007334011 A * | 12/2007 | ..... | G03G 21/10 |
| JP | 2010032585 A * | 2/2010 | ..... | G03G 21/10 |
| JP | 2012-185288 | 9/2012 | | |

*Primary Examiner* — Nguyen Ha

(74) *Attorney, Agent, or Firm* — Oblon, McClelland, Maier & Neustadt, L.L.P.

(57) ABSTRACT

A cleaner includes a cleaning member electrostatically removing toner on an object; a first electricity supplier supplying a first voltage (or current) with polarity opposite to that of toner to the cleaning member; a toner collecting member collecting toner from the cleaning member; and a second electricity supplier supplying a second voltage with the polarity greater than the first voltage to the toner collecting member. The first and second electricity suppliers set plural setting values of the first and second voltages smaller than the targeted values of the first and second voltages, and first and second control members of the first and second electricity suppliers output first and second control signals while changing in step-by-step manner so that first and second output members of the first and second electricity suppliers apply the first and second voltage in step-by-step manner before the first and second voltages reach the targeted voltages.

12 Claims, 14 Drawing Sheets

(56) References Cited

U.S. PATENT DOCUMENTS 8,862,020 B2 * 10/2014 Noguchi ..... G03G 21/0011 399/101
8,879,937 B2 * 11/2014 Zaima ..... G03G 15/5041 399/101
2005/0058474 A1 * 3/2005 Watanabe ..... G03G 21/0035 399/353
2007/0212139 A1 * 9/2007 Sugiura ..... G03G 21/0035 399/353
2008/0002997 A1 * 1/2008 Watanabe ..... G03G 21/10 399/35
2009/0232530 A1 * 9/2009 Saito ..... G03G 15/161 399/50
2009/0311004 A1 * 12/2009 Naruse ..... G03G 15/161 399/101
2010/0008706 A1 * 1/2010 Sugiura ..... G03G 21/0035 399/350
2010/0239302 A1 * 9/2010 Naruse ..... G03G 21/0035 399/71
2011/0085834 A1 4/2011 Naruse et al.
2011/0103822 A1 5/2011 Sugiura et al.
2011/0158677 A1 6/2011 Kikuchi et al.
2011/0229187 A1 9/2011 Hozumi et al.
2011/0229234 A1 9/2011 Hozumi et al.
2012/0003022 A1 * 1/2012 Pickering ..... G03G 21/0035 399/354
2012/0008973 A1 * 1/2012 Sakakibara ..... G03G 15/161 399/71
2012/0034006 A1 2/2012 Asaoka et al.
2012/0087704 A1 4/2012 Asaoka et al.
2012/0099883 A1 4/2012 Kikuchi et al.
2012/0224870 A1 9/2012 Kikuchi et al.
2013/0084095 A1 * 4/2013 Meguro ..... G03G 15/161 399/71
2013/0315617 A1 11/2013 Sugiura et al.
2014/0064769 A1 3/2014 Sugiura
2014/0314461 A1 10/2014 Ishizuka et al.
2014/0321874 A1 10/2014 Sugiura et al.

* cited by examiner

CLEANER, AND IMAGE FORMING APPARATUS USING THE CLEANER

CROSS-REFERENCE TO RELATED APPLICATIONS

This patent application is based on and claims priority pursuant to 35 U.S.C. §119 to Japanese Patent Application No. 2013-244259 filed on Nov. 26, 2013 in the Japan Patent Office, the entire disclosure of which is hereby incorporated by reference herein.

BACKGROUND

1. Technical Field

This disclosure relates to a cleaner, and to an image forming apparatus using the cleaner.

2. Description of the Related Art

Cleaners to remove residual toner using an electrostatic force have been used for removing residual toner on an intermediate transfer belt of image forming apparatus using an intermediate transfer method.

Specific examples of such cleaners include a cleaner in which three cleaning brush rollers serving as cleaning members are arranged side by side in a rotation direction of an intermediate transfer belt. One of the three cleaning brush rollers, which is arranged on the extreme upstream side relative to the rotation direction of the intermediate transfer belt, is a pre-cleaning brush roller to roughly remove normally charged toner on the intermediate transfer belt. The second cleaning brush roller, which is arranged on a downstream side from the pre-cleaning brush roller relative to the rotation direction of the intermediate transfer belt, removes reversely charged toner on the intermediate transfer belt. The third cleaning brush roller, which is arranged on a downstream side from the second cleaning brush roller relative to the rotation direction of the intermediate transfer belt, removes normally charged toner on the intermediate transfer belt. The cleaner further includes first, second and third toner collecting rollers to collect toner adhered to the corresponding cleaning brush rollers, and first, second and third scraping blades to scrape off toner adhered to the surface of the corresponding toner collecting rollers.

When a targeted voltage is applied to the pre-cleaning brush roller of the cleaner so that the pre-cleaning brush roller can generate a desired electrostatic force, the current flowing through the contact portion of the pre-cleaning brush roller with the intermediate transfer belt is detected. A power controller of a power source of the cleaner outputs a control signal to a power output member of the power source so that the power output member outputs the targeted voltage to the pre-cleaning brush roller, thereby generating the desired electrostatic force for the pre-cleaning brush roller.

The voltage applied by the power output member to the first toner collecting roller is adjusted so as to be the targeted voltage at which the difference between the potential of the pre-cleaning brush roller and the potential of the first toner collecting roller becomes a predetermined value (e.g., 400V) and a desired electrostatic force is formed on the first toner collecting roller such that the first toner collecting roller can collect the toner adhered to the pre-cleaning brush roller. In this regard, the absolute value of the targeted voltage applied to the first toner collecting roller is greater than that of the targeted voltage applied to the pre-cleaning brush roller.

Similarly to the case of the pre-cleaning brush roller, other power output members respectively apply targeted voltages to the second and third cleaning brush rollers. In addition, similarly to the case of the first toner collecting roller, the power controller outputs control signals to the corresponding power output members so that the power output members can apply targeted voltages to the second and third toner collecting rollers. Thus, desired electrostatic forces are generated for the first to third cleaning brush rollers and the first to third toner collecting rollers.

In this cleaner, the pre-cleaning brush roller, which is arranged on the extreme upstream side relative to the rotation direction of the intermediate transfer belt, roughly removes normally charged toner particles, which account for most of the residual (non-transferred) toner particles, and therefore the amount of the residual toner particles remaining on the intermediate transfer belt and being fed to the second cleaning brush roller (i.e., reversely charged toner cleaning brush roller) and the third cleaning brush roller (i.e., normally charged toner cleaning brush roller) is small. Therefore, the second and third cleaning brush rollers can easily remove the residual toner particles remaining on the intermediate transfer belt, resulting in enhancement of the cleaning effect.

SUMMARY

As an aspect of this disclosure, a cleaner is provided which includes a cleaning member to electrostatically remove toner which is charged with a first polarity and which is located on a rotatable object to be cleaned; a first electricity supplier to apply a first voltage or current with a second polarity opposite to the first polarity to the cleaning member so that the cleaning member electrostatically attracts the toner on the rotatable object; a toner collecting member to collect the toner from the cleaning member; and a second electricity supplier to apply a second voltage or current, which has the second polarity and which is greater than the first voltage or current in absolute value, to the toner collecting member so that the toner collecting member electrostatically attracts the toner on the cleaning member.

The first electricity supplier includes a first output member to output the first voltage or current to the cleaning member to form a predetermined electrostatic force on the cleaning member, and a first control member to output a first control signal to the first output member so that the first output member outputs the first voltage or current based on the first control signal. The second electricity supplier includes a second output member to output the second voltage or current to the toner collecting member to form a predetermined electrostatic force on the toner collecting member, and a second control member to output a second control signal to the second output member so that the second output member outputs the second voltage or current based on the second control signal.

The first electricity supplier sets plural setting values of the first voltage or current, which are not greater than the targeted value of the first voltage or current, and the first control member changes the first control signal in a step-by-step manner so that the first output member applies the first voltage or current while changing the first voltage or current in a step-by-step manner based on the plural setting values before the first voltage or current reaches the targeted voltage or current. The second electricity supplier sets plural setting values of the second voltage or current, which are not greater than the targeted value of the second voltage or current, and the second control member changes the second control signal in a step-by-step manner so that the second output member applies the second voltage or current while changing the second voltage or current in a step-by-step manner based on the plural setting values before the second voltage or the second current reaches the targeted voltage or current.

As another aspect of this disclosure, an image forming apparatus is provided which includes an image carrier; a toner image forming device to form a toner image on a surface of the image carrier; a transferring device to transfer the toner image on the image carrier to a recording medium; and the above-mentioned cleaner to remove residual toner from the surface of the image carrier.

Alternatively, an image forming apparatus is provided which includes an image carrier; a toner image forming device to form a toner image on a surface of the image carrier; a primary transferring device to transfer the toner image on the image carrier to an intermediate transfer medium; a secondary transferring device to transfer the toner image on the intermediate transfer medium to a recording medium; and the above-mentioned cleaner to remove residual toner from the surface of the intermediate transfer medium.

Alternatively, an image forming apparatus is provided which includes an image carrier; a toner image forming device to form a toner image on a surface of the image carrier; a transferring device to transfer the toner image on the image carrier to a recording medium at a transferring position; a recording medium feeder to feed the recording medium to the transferring position; and the above-mentioned cleaner to remove residual toner from a surface of the recording medium feeder.

The aforementioned and other aspects, features and advantages will become apparent upon consideration of the following description of the preferred embodiments taken in conjunction with the accompanying drawings.

DETAILED DESCRIPTION

Figure 1:
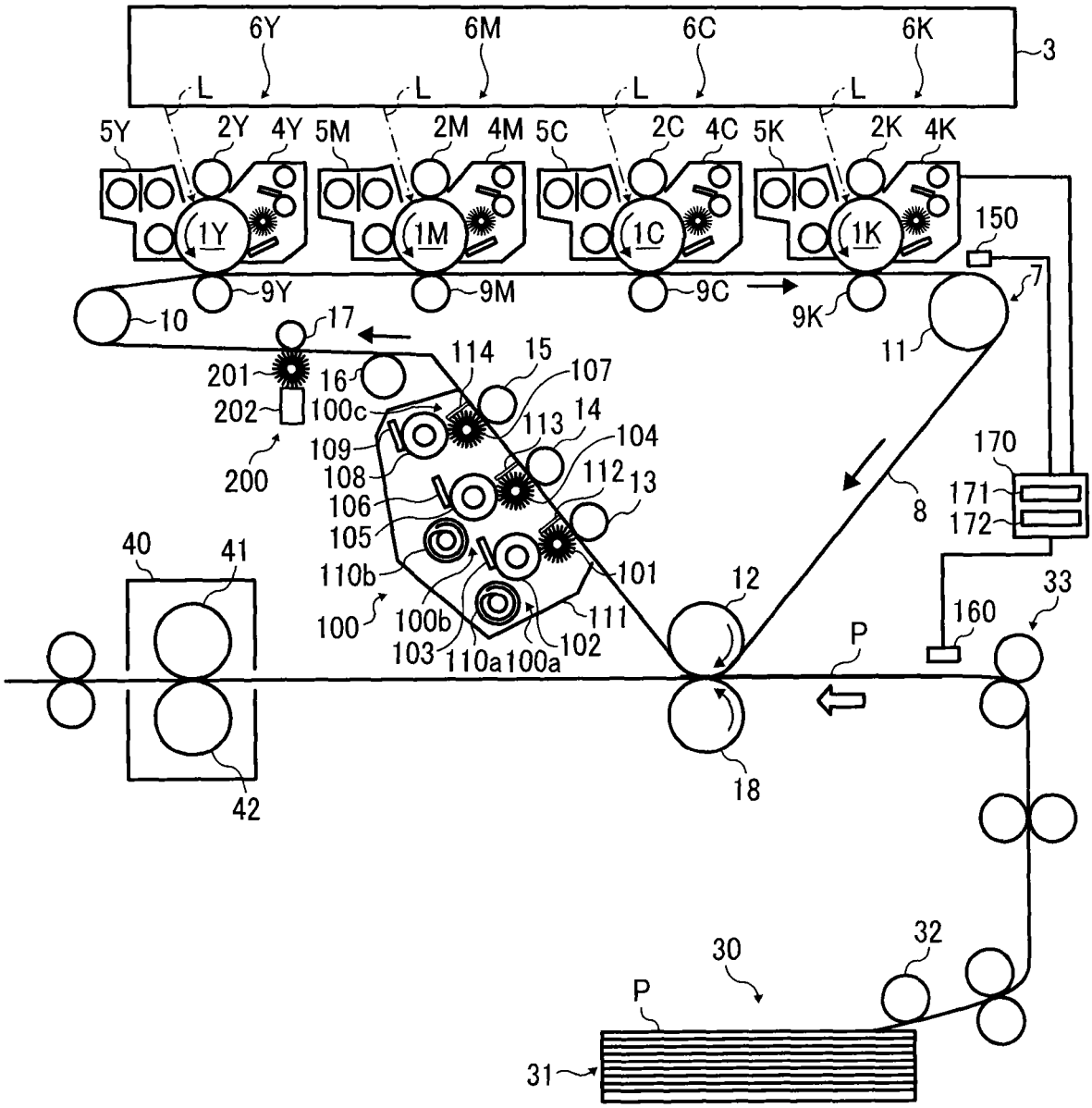
FIG. 1 is a schematic view illustrating the main portion of a printer as one example of the image forming apparatus according to an embodiment.

When a first power source applies a first voltage to a first object, which is electrically connected with a second object to which a second power source applies a voltage, a potential difference is generated between the first and second objects, wherein the potential difference changes depending on the resistance between the first and second objects. As a result of the potential difference, a current flows into the first or second power source, resulting in generation of an inflowing current. When such an inflowing current flows into the first or second power source, a problem in that the power source is defectively activated is often caused. Therefore, a protective circuit is typically provided for such a power source so that the power source can be securely activated even when an inflowing current not greater than a guaranteed amount of current flows into the power source.

In addition, an instruction for driving a cleaner is issued to the power source of the cleaner by a host device (e.g., personal computers) or the main body of the image forming apparatus including the cleaner. The power source typically includes a power controller and a power output member. The power controller outputs a control signal concerning the targeted voltage or current to the power output member according to the driving instruction. The power output member supplies the targeted voltage or current to the corresponding roller while performing constant voltage control or constant current control.

In the above-mentioned cleaner of related art, when an instruction for driving a cleaner is issued by a host device or the main body of the image forming apparatus, the power sources connected with the cleaning brush rollers and the toner collecting rollers almost simultaneously output the targeted voltages or currents to the cleaning brush rollers and the toner collecting rollers. In this regard, it takes about tens of milliseconds until the applied voltages or currents reach the targeted voltages or currents. In addition, there are variations of from a few milliseconds to tens of milliseconds in timing of activation of the power sources due to the individual difference of the power sources.

When the voltage applied from a power source to a toner collecting roller reaches the targeted voltage at a time earlier than the time at which the voltage applied from another power source to a cleaning brush roller corresponding to the toner collecting roller reaches the targeted voltage, a potential difference larger than the targeted potential mentioned above is generated between the cleaning brush roller and the toner collecting roller at a time in which the voltage applied from the power source to the toner collecting roller reaches the targeted voltage. Particularly when the power source connected with the cleaning brush roller is activated after the voltage applied to the toner collecting roller reaches the targeted voltage, the potential difference is equal to the voltage applied to the toner collecting roller (i.e., the potential difference is maximized) in a time period of from the time in which the voltage applied to the toner collecting roller reaches the targeted voltage to the time in which the power source for the cleaning brush roller is activated. In this case, it is possible that an inflowing current greater than the guaranteed voltage of the protective circuit of the power source flows into the power source for the toner collecting roller, which applies a voltage whose absolute value is greater than that of the voltage applied by the power source for the cleaning brush roller.

When deficient activation of the power source for the toner collecting roller is caused and therefore the power source for the toner collecting roller is not activated, the toner adhered to the cleaning brush roller cannot be collected. In this case, if the amount of toner adhered to the cleaning brush roller exceeds the maximum amount, defective cleaning is caused (i.e., the intermediate transfer belt is defectively cleaned).

When the voltage applied from the power source to the cleaning brush roller reaches the targeted voltage at a time earlier than the time at which the voltage applied from the power source to the toner collecting roller reaches the targeted voltage, a potential difference greater than the targeted potential is generated between the cleaning brush roller and the toner collecting roller at a time in which the voltage applied from the power source to the cleaning brush roller reaches the targeted voltage. In this case, depending on the value of the potential difference, it is possible that an inflowing current greater than the guaranteed voltage of the protective circuit of the power source flows into the power source for the cleaning brush roller. As a result, defective activation of the power source for the cleaning brush roller is caused, and thereby the intermediate transfer belt cannot be satisfactorily cleaned, resulting in occurrence of defective cleaning. In order to protect the power source from such a large inflowing current, an expensive protective circuit has to be provided, resulting in increase of costs of the power source.

This defective activation problem is not caused only to an intermediate transfer belt, and can be caused to other objects such as image carriers (such as photoreceptors) and recording medium feeders of image forming apparatus.

The object of this disclosure is to provide a cleaner, which can prevent occurrence of defective activation of power sources of the cleaner due to interference therebetween without increasing the costs of the power sources.

First Embodiment

Hereinafter, a tandem type printer using an intermediate transfer method (hereinafter referred to as a printer) as an example of the image forming apparatus according to an embodiment will be described. Initially, the basic configuration of the printer will be described by reference to drawings.

FIG. 1 is a schematic view illustrating a main portion of the printer. The printer includes four process units 6Y, 6M, 6C and 6K, which serve as toner image forming devices and which respectively form yellow (Y), magenta (M), cyan (C) and black (K) toner images.

The process units 6Y, 6M, 6C and 6K respectively include drum-shaped photoreceptors 1Y, 1M, 1C and 1K. Around the photoreceptors 1Y, 1M, 1C and 1K, chargers 2Y, 2M, 2C and 2K, developing devices 5Y, 5M, 5C and 5K, drum cleaners 4Y, 4M, 4C and 4K, and dischargers (not shown) are respectively arranged. The process units 6Y, 6M, 6C and 6K have the same configuration except that different color toners, i.e., Y, M, C and K toners, are used therefor.

An optical writing unit 3, which irradiates the photoreceptors 1 with laser light L to form electrostatic latent images thereon, is provided above the process units 6.

In this printer, the chargers 2, the developing devices 5 and the optical writing unit 3 serve as a toner image forming device.

A transfer unit 7 including an intermediate transfer belt 8, which is a rotatable endless image carrier, is provided below the process units 6. The transfer unit 7 further includes plural stretching rollers, which are arranged inside the loop of the intermediate transfer belt 8, and a secondary transfer roller 18, a tension roller 16, a belt cleaner 100, and a lubricant applicator 200, which are arranged outside the loop of the intermediate transfer belt.

Inside the loop of the intermediate transfer belt 8, four primary transfer rollers 9Y, 9M, 9C and 9K, a driven roller 10, a driving roller 11, a secondary transfer counter roller 12, and three cleaner counter rollers 13, 14 and 15, and a lubricant applicator counter roller 17 are arranged.

These rollers serve as stretching rollers to stretch the intermediate transfer belt 8. In this regard, the cleaner counter rollers 13, 14 and 15 do not necessarily apply a tension to the intermediate transfer belt 8, and may be driven by the rotated intermediate transfer belt.

The intermediate transfer belt 8 is rotated clockwise by the driving roller 11, which is rotated clockwise by a driving device (not shown).

The primary transfer rollers 9Y, 9M, 9C and 9K, which are arranged inside the loop of the intermediate transfer belt 8, and the photoreceptors 1Y, 1M, 1C and 1K sandwich the intermediate transfer belt 8, and therefore primary transfer nips are formed between the outer surface of the intermediate transfer belt 8 and the photoreceptors 1 to transfer Y, M, C and K toner images.

In this regard, primary transfer biases with a polarity opposite to that of charge of the toners are applied to the primary transfer rollers 9Y, 9M, 9C and 9K, respectively, by power sources (not shown).

The secondary transfer counter roller 12 arranged inside the loop of the intermediate transfer belt 8 and the secondary transfer roller 18 arranged outside the loop sandwich the intermediate transfer belt 8, thereby forming a secondary transfer nip between the outer surface of the intermediate transfer belt and the surface of the secondary transfer roller.

In this regard, a secondary transfer bias with a polarity opposite to that of charge of the toners is applied to the secondary transfer roller 18 by a power source (not shown). In addition, a recording medium feeding belt may be provided which is supported by the secondary transfer roller 18, and several support rollers so that a recording medium P is fed by the recording medium feeding belt to the secondary transfer nip at which the intermediate transfer belt 8 and the recording medium feeding belt are sandwiched by the secondary transfer roller 18 and the secondary transfer counter roller 12.

The three cleaner counter rollers 13, 14 and 15, which are arranged inside the loop of the intermediate transfer belt 8, and cleaning brush rollers 101, 104 and 107 of the belt cleaner 100 sandwich the intermediate transfer belt 8, thereby forming cleaning nips (i.e., contact portions) therebetween.

The belt cleaner 100 and the intermediate transfer belt 8 are integrated so as to be replaced as a unit. However, if the belt cleaner 100 and the intermediate transfer belt 8 have different lives, it is possible for the belt cleaner 100 to be detachably attachable to the printer independently of the intermediate transfer belt 8. The belt cleaner 100 will be described later in detail.

The printer further includes a recording medium feeder 30 including a recording medium cassette 31 to contain sheets of the recording medium P such as papers, and a feed roller 32 to feed the recording medium P to a sheet passage having several feed rollers to feed the recording medium P from the cassette toward the secondary transfer nip. In addition, the printer also includes a pair of registration rollers 33, which is arranged on the right side of the secondary transfer nip to feed the recording medium P fed from the cassette toward the secondary transfer nip at a predetermined time so that the toner image on the intermediate transfer belt 8 is transferred onto a proper position of the recording medium at the secondary transfer nip. Further, the printer includes a fixing device 40, which is located on the left side of the secondary transfer nip and which receives the recording medium P bearing the toner image thereon and fed from the secondary transfer nip to fix the toner image to the recording medium using a heat roller 41 and a pressure roller 42. The printer optionally includes toner supplying devices to respectively supply the Y, M, C and K toners to the developing devices 5Y, 5M, 5C and 5K.

Recently, not only plain papers, but also papers having concave and convex on the surface thereof to modify the design thereof and recording papers used for thermal transferring (iron printing) have been used for image forming apparatuses. When such special papers are used as the recording medium P, defective image transferring is often caused when a toner image on the intermediate transfer belt 8 is transferred onto the special papers.

Therefore, in this printer, an elastic layer with a low hardness is formed on the intermediate transfer belt 8 so that the intermediate transfer belt 8 can be deformed when being contacted with such a rough paper with the toner image therebetween. Namely, the intermediate transfer belt having such an elastic layer with a low hardness is easily deformed, and therefore the surface of the intermediate transfer belt can be contacted with the concave of such a rough paper.

Since such an elastic layer is formed, the toner image on the intermediate transfer belt 8 can be satisfactorily adhered to the surface of the rough paper without excessively increasing the transfer pressure, thereby making it possible to evenly transfer the toner image onto the rough paper without causing defective transferring (such as uneven transferring of toner images, and formation of omissions in character images).

The intermediate transfer belt 8 of this printer includes at least a base layer, an elastic layer overlying the base layer, and an outermost coat layer overlying the elastic layer. In this regard, "overlying" can include direct contact and allow for one or more intermediate layers.

Suitable materials for use in the elastic layer of the intermediate transfer belt 8 include elastic rubbers and elastomers.

Specific examples of the material for use in the elastic layer include, but are not limited thereto, rubbers such as butyl rubbers, fluorine-containing rubbers, acrylic rubbers, EPDM (ethylene-propylene-diene rubbers), NBR (acrylonitrile-butadiene rubbers), acrylonitrile-butadiene-styrene rubbers, natural rubbers, isoprene rubbers, styrene-butadiene rubbers, butadiene rubbers, urethane rubbers, syndiotactic 1,2-polybutadiene, epichlorohydrin rubbers, polysulfide rubbers, and polynorbonene rubbers; and thermoplastic elastomers such as polystyrene, polyolefin, polyvinyl chloride, polyurethane, polyamide, polyurea, polyester, and fluorine-containing resins. These materials can be used alone or in combination.

The thickness of the elastic layer is determined depending on the hardness of the material of the elastic layer and the layer structure of the intermediate transfer belt, and is preferably from 0.07 mm to 0.8 mm, and more preferably from 0.25 mm to 0.5 mm. When the thickness is less than 0.07 mm, the pressure to the toner image on the intermediate transfer belt 8 seriously increases at the secondary transfer nip, thereby often causing the omission problem in that omissions are formed in the transferred toner image. In addition, the transfer rate of toner images tends to decrease.

The hardness (JIS-A hardness) of the elastic layer is preferably from 10 degree to 65 degree. The optimum hardness of the elastic layer changes depending on the thickness of the intermediate transfer belt 8. However, when the JIS-A hardness is lower than 10 degree, the omission problem mentioned above tends to be caused. In contrast, when the JIS-A hardness is higher than 65 degree, it often becomes difficult to stretch the intermediate transfer belt 8 with rollers. In addition, when the intermediate transfer belt 8 is tightly stretched for a long period of time, the belt tends to be extended, resulting in shortening of the life of the belt.

The base layer of the intermediate transfer belt 8 is preferably constituted of a resin having a small extension rate. Specific examples of the material for use in the base layer include, but are not limited thereto, polycarbonates, fluorine-containing resins (such as ETFE (ethylene-tetrafluoroethylene copolymers) and PVDF (polyvinylidene fluoride)), styrene resins (homopolymers and copolymers of styrene and styrene derivatives) such as polystyrenes, chlorinated polystyrenes, poly-α-methylstyrenes, styrene-butadiene copolymers, styrene-vinyl chloride copolymers, styrene-vinyl acetate copolymers, styrene-maleic acid copolymers, styrene-acrylate copolymers (such as styrene-methyl acrylate copolymers, styrene-ethyl acrylate copolymers, styrene-butyl acrylate copolymers, styrene-octyl acrylate copolymers, and styrene-phenyl acrylate copolymers), styrene-methacrylate copolymers (such as styrene-methyl methacrylate copolymers, styrene-ethyl methacrylate copolymers, and styrene-phenyl methacrylate copolymers), styrene-methyl α-chloroacryalte copolymers, and styrene-acrylonitrile-acrylate copolymers; methyl methacryalte resins, butyl methacrylate resins, ethyl acrylate resins, butyl acrylate resins, modified acrylic resins (such as silicone-modified acrylic resins, vinyl chloride-modified acrylic resins, and acrylic-urethane resins), vinyl chloride resins, styrene-vinyl acetate resins, vinyl chloride-vinyl acetate copolymers, rosin-modified maleic resins, phenolic resins, epoxy resins, polyester resins, polyester polyurethane resins, polyethylene resins, polypropylene resins, polybutadiene resins, polyvinylidene chloride resins, ionomer resins, polyurethane resins, silicone resins, ketone resins, ethylene-ethylacrylate copolymers, xylene resins, polyvinyl butyral resins, polyamide resins, and modified polyphenyleneoxide resins. These materials can be used alone or in combination.

In order to prevent extension of the elastic layer, which is typically constituted of a material such as rubber having a large extension rate, a core layer constituted of an extension preventing material such as fibers and cloth can be formed between the base layer and the elastic layer.

Specific examples of such an extension preventing material for use in the core layer include, but are not limited thereto, yarns or cloths of natural fibers such as cotton and silk; synthetic fibers such as polyester fibers, nylon fibers, acrylic fibers, polyolefin fibers, polyvinyl alcohol fibers, polyvinyl chloride fibers, polyvinylidene chloride fibers, polyurethane fibers, polyacetal fibers, polyfluoroethylene fibers, and phenolic fibers; inorganic fibers such as carbon fibers, and glass fibers; and metal fibers such as iron fibers, and copper fibers. These materials can be used alone or in combination.

The yarns, which are used alone or used for cloths, are not particularly limited, and any known yarns such as yarn in which one or more filaments are twisted, single-twisted yarn, double-twisted yarn, and two-folded yarn can be used. These yarns can be used alone or in combination. In addition, the yarns can be subjected to an electroconductive treatment.

Any woven cloths such as stockinet can be used for the core layer. In addition, union cloths can also be used, and cloths subjected to an electroconductive treatment can be used.

The outermost coat layer of the intermediate transfer belt 8 is formed by coating the surface of the elastic layer, and preferably has a smooth surface.

The material constituting the outermost coat layer is not particularly limited, but materials having low adhesiveness to toner are preferably used to enhance the secondary transferring property of the intermediate transfer belt 8.

For example, one or more of polyurethane resins, polyester resins, and epoxy resins can be used for the outermost coat layer. In addition, one or more of particulate materials having low surface energy while having good lubricity such as fluorine-containing resins, fluorine compounds, carbon fluoride, titanium oxide, and silicon carbide, can be dispersed in the outermost coat layer. If desired, particulate materials having different particle diameters are dispersed in the outermost coat layer.

It is possible to form a layer of fluorine on the surface of the outermost coat layer by subjecting a fluorine-containing rubber to a heat treatment so that the outermost coat layer has low surface energy.

In order to adjust the resistance of the base layer, the elastic layer, and the outermost coat layer, electroconductive materials such as carbon black, graphite, powders of metals such as aluminum and nickel, and electroconductive metal oxides such as tin oxide, titanium oxide, antimony oxide, indium oxide, potassium titanate, antimony oxide-tin oxide complex oxides (ATO), indium oxide-tin oxide complex oxides (ITO) can be used for the layers.

In this regard, the electroconductive metal oxides may be materials in which a particulate insulating material such as barium sulfate, magnesium silicate, and calcium carbonate is covered with such a metal oxide as mentioned above. The resistance adjusting material is not limited to these materials.

The surface of the intermediate transfer belt 8 is coated with a lubricant by the lubricant applicator 200 to protect the surface. The lubricant applicator 200 includes a solid lubricant 202 such as block of zinc stearate, and a brush roller 201 which is contacted with the solid lubricant 202 while rotated to scrape off the lubricant and to apply the lubricant to the surface of the intermediate transfer belt 8.

This printer includes the lubricant applicator 200, but the image forming apparatus of this disclosure does not necessarily include such a lubricant applicator depending on choice of toner, choice of the material of the intermediate transfer belt, and the friction coefficient of the surface of the intermediate transfer belt 8.

Next, the image forming operation of the printer will be described.

When image information is sent from a personal computer or the like, the printer rotates the driving roller 11 to rotate the intermediate transfer belt 8. In this regard, the stretching rollers other than the driving roller 11 are driven by the intermediate transfer belt 8. At the same time, the printer rotates the photoreceptors 1 of the process units 6.

The surfaces of the photoreceptors 1 are charged by the corresponding chargers 2, and then irradiated with laser light L emitted by the irradiator 3 to form electrostatic latent images thereon. The electrostatic latent images thus formed on the photoreceptors 1 are developed by the corresponding developing devices 5 to form Y, M, C and K toner images on the photoreceptors.

The Y, M, C and K toner images thus formed on the photoreceptors 1 are transferred onto the outer surface of the intermediate transfer belt 8 at the primary transfer nips (i.e., Y, M, C and K nips) so as to be overlaid, thereby forming a combined four color toner image on the outer surface of the intermediate transfer belt.

Meanwhile, sheets of the recording medium P are fed one by one from the recording medium cassette 31 toward the pair of registration rollers 33. The pair of registration rollers 33 is timely rotated so that the combined four color toner image on the intermediate transfer belt 8 is transferred onto a proper position of a sheet of the recording medium P at the secondary transfer nip. Thus, a full color toner image is formed on the sheet of the recording medium P. The sheet of the recording medium P bearing the full color toner image thereon is fed to the fixing device 40 to fix the full color toner image, thereby forming a full color image.

After the Y, M, C and K toner images are transferred onto the outer surface of the intermediate transfer belt 8 at the primary transfer nips, the surfaces of the photoreceptors 1 are cleaned by the corresponding drum cleaners 4 to remove residual toner from the surfaces. Next, the photoreceptors 1 are discharged by discharging lamps, and then charged by the chargers 2 so that the photoreceptors are ready for the next image forming operation.

After the combined color toner image on the intermediate transfer belt 8 is transferred to the recording medium P at the secondary transfer nip, the surface of the intermediate transfer belt 8 is cleaned by the belt cleaner 100 to remove residual toner from the surface. In this regard, the cleaning brush rollers and the toner collecting rollers of the belt cleaners 100 are rotated in synchronization with rotation of the driving roller 11. After a certain period of time (e.g., 50 ms) from the start of rotation of the cleaning brush rollers and the toner collecting rollers, biases start to be applied to the rollers. This driving operation of the belt cleaner 100 is also performed when the power of the printer is turned on, an image density adjusting operation is performed, and the printer receives a print job order.

Referring to FIG. 1, an optical sensor unit 150 is provided on the right side of the K process unit 6K so as to be opposed to the outer surface of the intermediate transfer belt 8 with a predetermined distance. The optical sensor unit 150 is connected with a controller 170, which includes a random access memory 171 and a central processing unit 172.

Figure 2:
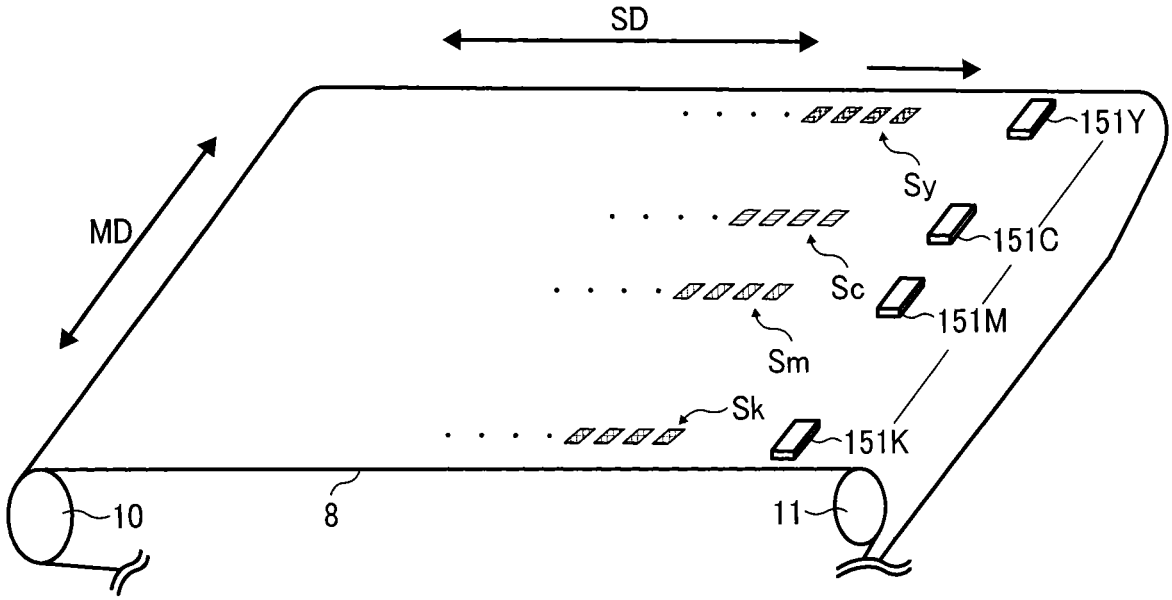
FIG. 2 is a schematic view illustrating an intermediate transfer medium of the printer, on which half tone images are formed, and optical sensors provided in the vicinity of the intermediate transfer medium.

As illustrated in FIG. 2, the optical sensor unit 150 includes a Y optical sensor 151Y, a cyan optical sensor 151C, a M optical sensor 151M, and a K optical sensor 151K, which are arranged in the width direction of the intermediate transfer belt 8. In FIG. 2, MD denotes a main scanning direction, and SD represents a sub-scanning direction.

Each of these optical sensors 151 is a reflection type photosensor having a configuration such that light emitted from a light-emitting element (not shown) and reflected from the outer surface of the intermediate transfer belt 8 or a toner image on the belt is detected by a light receiving element (not shown) to determine the light quantity of reflection light.

The controller 170 detects a toner image on the intermediate transfer belt 8 and the image density (i.e., weight of toner per a unit area) of the toner image based on the output voltage from the optical sensors 151Y, 151C, 151M and 151K.

Whenever the printer is turned on or a predetermined number of prints are formed, process control (image quality control) is performed to check the operations of the devices of the printer, to set the operation conditions, and to maintain the quality of images based on the detection results of the optical sensors. Specific examples of the image quality control include image density control for optimizing the image densities of color images, and misalignment correction processing for correcting misalignment of color images.

In the image density control, half tone color toner images Sk, Sm, Sc and Sy (hereinafter referred to as half tone images) are automatically formed on positions of the intermediate transfer belt 8 such that the color images can face the corresponding optical sensors 151K, 151M, 151C, 151Y, respectively, as illustrated in FIG. 2. Each of the half tone images Sk, Sm, Sc and Sy has 10 toner images (hereinafter referred to as toner patches) which have different image densities and each of which has a size of 2 cm×1 cm.

When the half tone images Sk, Sm, Sc and Sy are formed, the potential of each of the photoreceptors 1 charged by the corresponding charger 2 is gradually increased unlike the normal charging process in which the photoreceptor is evenly charged to have a predetermined potential. Next, the photoreceptors 1 are scanned with laser light to form electrostatic latent images of the half tone images on the photoreceptors, and the electrostatic latent images are developed with the corresponding developing devices 5K, 5M, 5C and 5Y. In this development operation, each of the development biases applied to the developing rollers of the developing devices 5 is gradually increased. Thus, K, M, C and Y half tone images Sk, Sm, Sc and Sy are formed on the respective photoreceptors 1.

These half tone images Sk, Sm, Sc and Sy are primarily transferred onto the intermediate transfer belt 8 so as to be arranged in the width direction of the intermediate transfer belt (i.e., in the main scanning direction MD) at regular intervals as illustrated in FIG. 2. In this regard, the weight of the toner patch having the lowest image density is about 0.1 mg/cm$^2$, and the weight of the toner patch having the highest image density is about 0.55 mg/cm$^2$. In addition, the polarity of the color toners is the same, and each of the toners has a normal Q/d (i.e., (charge quantity)/(diameter)) distribution.

The half tone images Sk, Sm, Sc and Sy formed on the intermediate transfer belt 8 pass under the respective optical sensors 151K, 151M, 151C and 151Y as the intermediate transfer belt makes endless movement. In this case, the optical sensors 151 receive light, which is reflected from the toner patches of the half tone images Sk, Sm, Sc and Sy and whose amount changes depending on the weight of the toner constituting the toner patches.

Next, the weights of the toners constituting the toner patches are calculated from the output voltages from the optical sensors 151 using a voltage-toner weight conversion algorithm, and the image forming conditions are adjusted based on the thus determined weights of the toners.

Specifically, the relation between the toner weights of the toner patches and the development potentials in formation of the toner patches is graphed to obtain a function (y=ax+b) using a regression analysis method. By assigning a target image density to the function, a proper development bias can be calculated. Thus, the development biases for the developing devices 5Y, 5M, 5C and 5K can be determined.

A memory of the controller (such as the CPU illustrated in FIG. 5) stores an image forming condition data table showing the relation between the development bias (in tens of levels) and the potentials of the photoreceptor. A development bias, which is nearest to the above-determined development bias, is selected from the data table for each of the process units 6Y, 6M, 6C and 6K, and the charge potential of the photoreceptor of the process unit corresponding to the development bias is determined.

Figure 3:
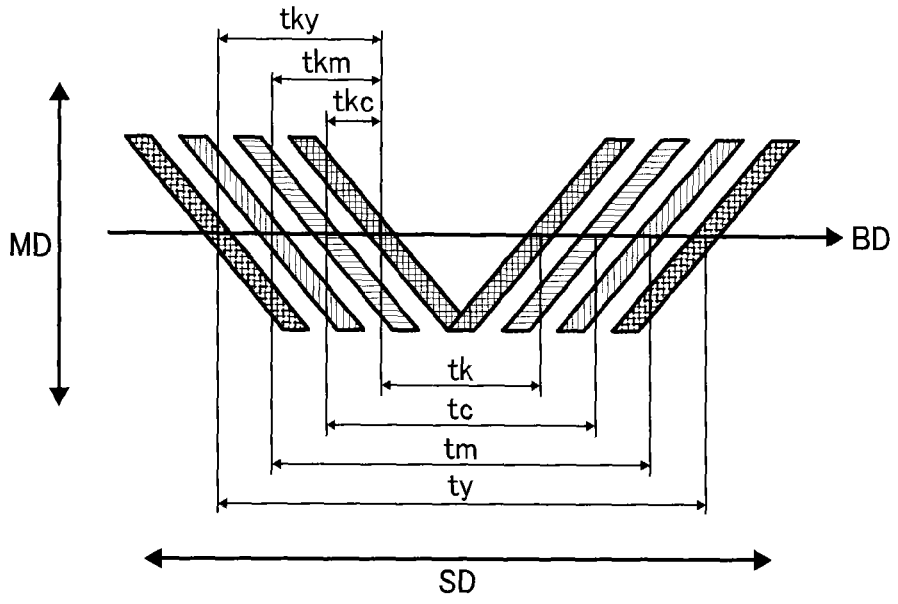
FIG. 3 is a schematic view illustrating a chevron patch formed on the intermediate transfer medium.

In the misalignment correction processing, a chevron patch, which is constituted of Y, M, C and K color images as illustrated in FIG. 3, is formed on both end portions of the intermediate transfer belt 8 in the width direction thereof.

The chevron patch includes Y, M, C and K line images which are slanted by about 45° relative to the main scanning direction MD and which are arranged at regular intervals in a belt moving direction BD (i.e., the sub-scanning direction SD). The weight of the toner images of the chevron patch is about 0.3 mg/cm$^2$.

The Y, M, C and K color toner images of the chevron patches formed on both the end portions of the intermediate transfer belt 8 are detected to determine the positions of each toner image in the main scanning direction (MD) and the sub-scanning direction (SD), error in magnification ratio of each toner image in the main scanning direction, and skew of each toner image from the main scanning direction.

In this regard, the main scanning direction MD means the direction corresponding to the width direction of the photoreceptor, along which laser light reflected from a polygon mirror scans the surface of the photoreceptor 1.

The Y, M, C and K toner images of the chevron patch are detected by the respective optical sensors 151Y, 151M, 151C and 151K to determine the time differences (tky, tkm and tkc) between the K image (reference image) and each of the Y, M and C images. In the chevron patch illustrated in FIG. 3, Y, M, C and K images (left four color images) are arranged from the left side, and other K, C, M and Y images (right four color images), which are slanted by 90° relative to the left four color images, are arranged in this order in the belt moving direction BD (i.e., the sub-scanning direction SD). The data of the time differences (tky, tkm and tkc) are compared with the theoretical values thereof to determine the displacement of each toner image in the sub-scanning direction, i.e., the mis-registration. Based on the thus determined mis-registration, the optical image writing timing is adjusted by changing the reflection surface of the polygon mirror to reduce the mis-registration. In this regard, when the reflection surface of the polygon mirror is changed to the adjacent reflection surface, the change is a one-unit change.

In addition, the slant (skew) of each of the Y, M, C and K toner images relative to the main scanning direction MD is determined based on the mis-registrations in the sub-scanning direction on both the end portions of the intermediate transfer belt 8. Next, correction of the optical face tangle error of the polygon mirror is performed based on the results to reduce the skew of the toner images.

As mentioned above, the optical image writing timing is adjusted and the optical face tangle error is corrected based on the times, at which the toner images of the chevron patches are detected, to reduce the mis-registration and the skew of the images. This processing is a misalignment correction processing.

By performing this misalignment correction processing, occurrence of the misalignment problem in that positions of the color toner images change with time due to change of the environmental temperature, etc., can be prevented.

In FIG. 3, characters tk, tc, tm and ty respectively represent the difference between two black images, the difference between two cyan images, the difference between two magenta images, and the difference between two yellow images.

The toner images formed on the intermediate transfer belt 8 in the image density control and the misalignment correction processing are not transferred to the recording medium P, and therefore the non-transferred toner images have to be removed by the belt cleaner 100. Therefore, when the setting of the operation condition (applied voltage) of the belt cleaner 100 is changed in the process control, it is preferable that the change of the setting is performed at the start of the process control or at least before the toner images are formed and the image density control and the misalignment correction processing are performed using the toner images.

Not only the toner images formed on the intermediate transfer belt 8 in the image density control and the misalignment correction processing, but also toner remaining on the intermediate transfer belt without being transferred to the recording medium P enter the belt cleaner 100.

In addition, when images with a low image area proportion are continuously produced, the amount of aged toner, which stays in the developing device 5 for a long period of time, increases, and therefore the charge property of the toner in the developing device deteriorates, thereby producing images having poor image quality (due to deterioration of developing ability and transferring property of the toner). Therefore, in order to prevent increase of the amount of such aged toners, the printer can offer a refresh mode in which toner images are formed on non-image areas of the photoreceptors 1 at predetermined times to use the toners in the developing devices 5 while supplying new toners to the developing devices to control the toner concentration in the developing devices (i.e., to refresh the toners in the developing devices). Since the toner images formed on the non-image areas of the photoreceptors 1 are transferred onto the intermediate transfer belt 8 and the toner images are not transferred onto the recording medium P, the toner images also enter the belt cleaner 100.

The controller 170 illustrated in FIG. 1, which includes the random access memory (RAM) 171 and the central processing unit (CPU) 172, stores the consumption data of the Y, M, C and K toners in the developing devices 5Y, 5M, 5C and 5K, and the operating times of the developing devices. At a predetermined time (e.g., after the developing devices are operated for a predetermined time), the controller checks whether the toner consumption is less than a threshold value for each developing device. If the toner consumption in a developing device is less than the threshold value, the controller switches the developing device into the refresh mode.

Figure 4:
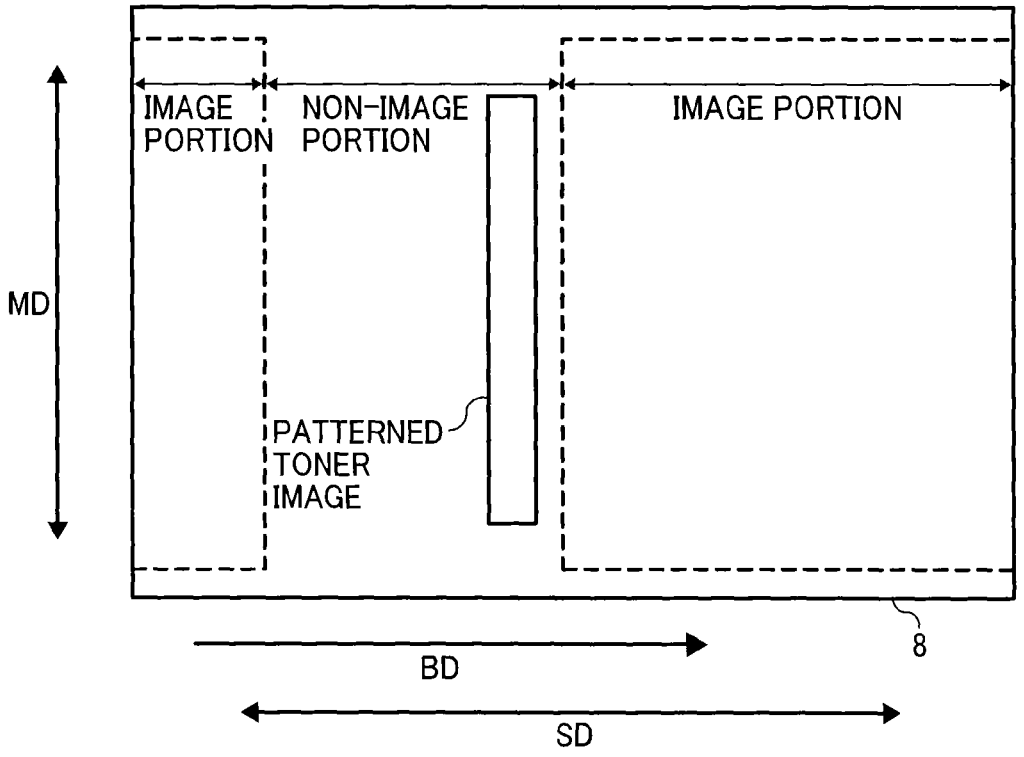
FIG. 4 is a schematic view illustrating a toner test pattern formed on the intermediate transfer medium.

In the refresh mode, a patterned image of each toner having a rectangular shape with a size of 250 mm×30 mm is formed on a non-image portion (a portion between two adjacent images) of the corresponding photoreceptor 1 depending on the consumption of the toner. As illustrated in FIG. 4, the patterned images of the toners are transferred onto a non-image portion (NIP) of the intermediate transfer belt 8, which is present between adjacent image portions (IP).

The toner weight of the patterned toner image is determined based on the ratio (C/O) of the toner consumption (C) to the operating time (O) of the developing device 5, and the maximum toner weight is about 1.2 mg/cm$^2$. When the Q/d ((charge quantity)/(diameter)) property of the patterned toner image transferred onto the intermediate transfer belt 8 is measured, it is confirmed that the toner has a normal Q/d distribution. The length of the patterned toner image in the main scanning direction MD is set to be 250 mm in this embodiment.

The half tone images, the chevron patches, and the patterned toner images formed on the intermediate transfer belt 8 are removed therefrom by the belt cleaner 100. In this case, the belt cleaner 100 has to remove a large amount of toners from the surface of the intermediate transfer belt 8.

In addition, when jamming of the recording medium P occurs (i.e., abnormal image formation occurs), a toner image remains on the intermediate transfer belt 8 without being transferred to the recording medium. Whether jamming of the recording medium P occurs can be determined by a sensor 160 (illustrated in FIG. 1), which detects the recording medium P, and the controller 170 which is connected with the sensor 160 and which judges whether jamming occurs based on the detection result of the sensor.

In this regard, it is difficult to remove such a large amount of non-transferred toners at one time using a conventional cleaner such as combination cleaners of a polarity controller and a brush roller, and combination cleaners of a first brush roller to remove a positive toner and a second brush roller to remove a negative toner.

In this case, residual toner remaining on the intermediate transfer belt 8 is transferred onto the recording medium P in the next image forming operation, resulting in formation of a defective image (i.e., occurrence of a background development problem in that the background of an image is soiled with residual toner).

The belt cleaner 100 of the image forming apparatus of this disclosure can remove such half tone images, chevron patches, and patterned toner images formed on the intermediate transfer belt 8 at one time. Hereinafter, the belt cleaner 100 will be described in detail.

Figure 5:
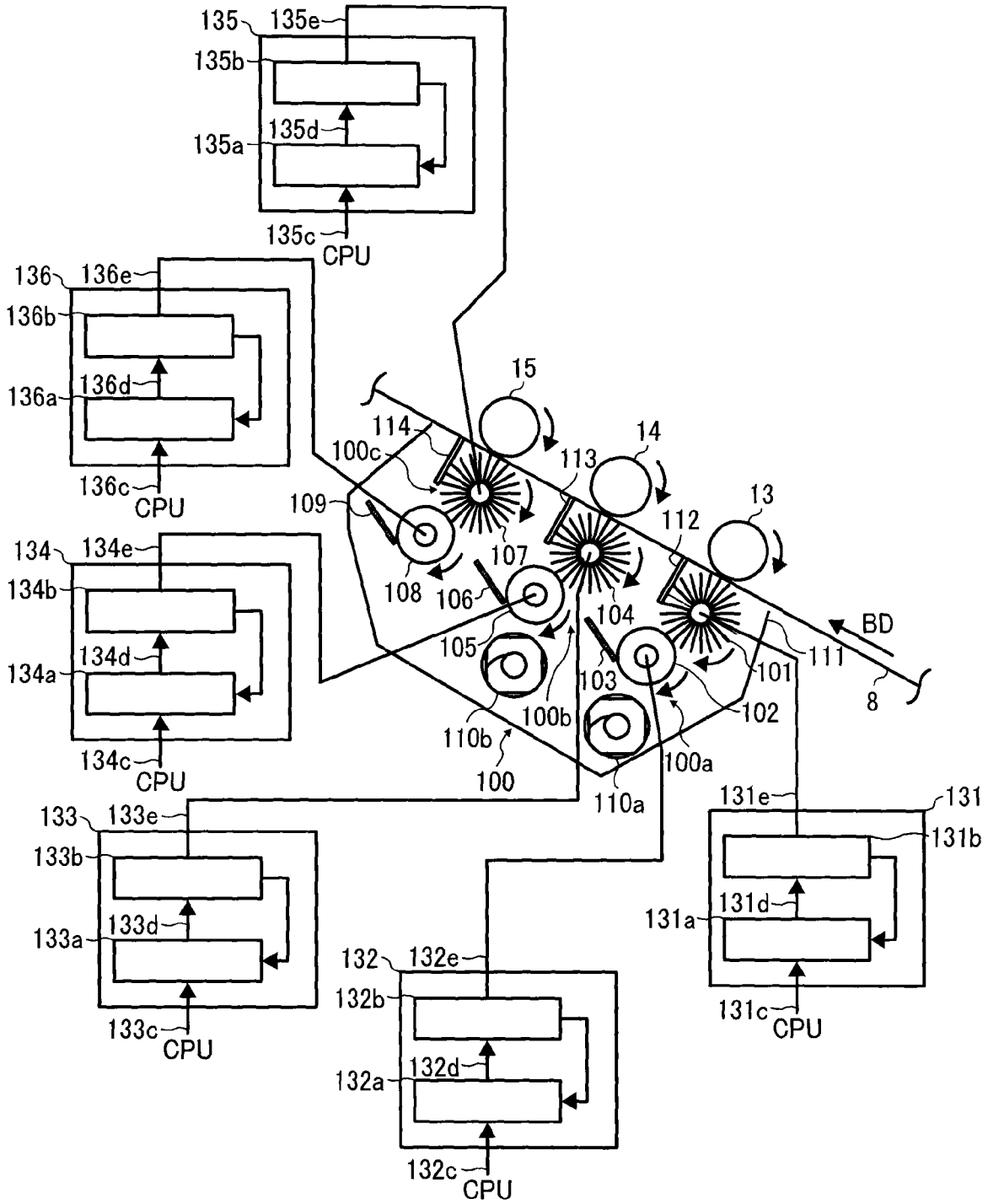
FIG. 5 is a schematic view illustrating a belt cleaner of the printer and vicinity thereof.

FIG. 5 illustrates the belt cleaner 100 of the printer and the vicinity thereof.

Referring to FIG. 5, the belt cleaner 100 includes a first cleaning portion 100*a*, which is provided on the extreme upstream side relative to the belt moving direction (BD) to roughly remove non-transferred toner images on the intermediate transfer belt 8. In addition, a second cleaning portion 100*b* is provided on a downstream side from the first cleaning portion 100*a* relative to the belt moving direction (BD) to electrostatically remove reversely-charged toner particles (i.e., when the toner is a negative toner, the reversely charged toner is a positive toner) remaining on the intermediate transfer belt 8. Further, a third cleaning portion 100*c* is provided on a downstream side from the second cleaning portion 100*b* relative to the belt moving direction (BD) to remove normally charged toner particles remaining on the intermediate transfer belt 8.

As illustrated in FIG. 5, the first to third cleaning portions 100*a*, 100*b* and 100*c* respectively include first to third cleaning brush rollers 101, 104 and 107 each of which serves as a cleaning member; first to third cleaning power sources 131, 133 and 135 (each of which serves as a first electricity supplier) to apply a voltage to the corresponding first to third cleaning brush rollers; first to third toner collecting rollers 102, 105 and 108 each of which serves as a toner collecting member; and first to third toner collecting power sources 132, 134 and 136 (each of which serves as a second electricity supplier) to apply a voltage to the corresponding first to third toner collecting rollers.

The first to third cleaning power sources 131, 133 and 135 respectively include power control members 131*a*, 133*a* and 135*a* (each of which serves as a first control member), and power output members 131*b*, 133*b* and 135*b* (each of which serves as a first output member).

The power control members 131*a*, 133*a* and 135*a* respectively output control signals 131*d*, 133*d* and 135*d* based on the output producing instruction and the targeted value output instruction signals 131*c*, 133*c* and 135*c* output by a central processing unit (CPU) (such as the CPU 172 of the controller 170 illustrated in FIG. 1) serving as a main controller. The power output members 131*b*, 133*b* and 135*b* respectively output voltages or currents 131*e*, 133*e* and 135*e* to the first to third cleaning brush rollers 101, 104 and 107 based on the control signals 131*d*, 133*d* and 135*d*.

The first to third toner collecting power sources 132, 134 and 136 respectively include power control members 132*a*, 134*a* and 136*a* (each of which serves as a second control member), and power output members 132*b*, 134*b* and 136*b* (each of which serves as a second output member). The power control members 132*a*, 134*a* and 135*a* respectively output control signals 132*d*, 134*d* and 136*d* based on the output producing instruction and the targeted value output instruction signals 132*c*, 134*c* and 136*c* output by the CPU. The power output members 132*b*, 134*b* and 136*b* respectively output voltages or currents 132*e*, 134*e* and 136*e* to the first to third toner collecting rollers 102, 105 and 108 based on the control signals 132*d*, 134*d* and 136*d*.

The first cleaning portion 100*a* includes the first cleaning brush roller 101 serving as a pre-cleaning member. In addition, the first cleaning portion 100*a* includes the first toner collecting roller 102, which serves as a pre-toner-collecting member to collect the toner adhered to the first cleaning brush roller 101, and a first scraping blade 103 to scrape off the toner adhered to the surface of the first toner collecting roller 102.

Almost all the toner particles constituting a non-transferred toner image are normally charged (in this case, the Y, M, C and K toners are negatively charged). Therefore, a positive voltage, which is opposite to the polarity of the normally charged toner, is applied to the first cleaning brush roller 101 to electrostatically remove negatively charged toner particles remaining on the intermediate transfer belt 8. In addition, a positive voltage greater than the positive voltage applied to the first cleaning brush roller 101 is applied to the toner collecting roller 102 to satisfactorily collect the toner adhered to the first cleaning brush roller 101. In this belt cleaner 100, the voltage applied to the first cleaning brush roller 101 is set to a voltage such that 90% of the toner particles constituting the non-transferred toner image can be removed by the first cleaning brush roller.

In addition, the first cleaning portion 100*a* includes a feeding screw 110*a* to feed the collected toner particles to a waste toner tank (not shown) provided on the main body of the printer.

The second cleaning portion 100*b*, which is arranged on a downstream side from the first cleaning portion 100*a* relative to the belt moving direction BD, includes the second cleaning brush roller 104 serving as a reversely-charged toner cleaning member to electrostatically remove reversely charged toner particles; the second toner collecting roller 105, which serves as a reversely-charged toner collecting member and which collects the toner adhered to the second cleaning brush roller 104; and a second scraping blade 106, which serves as a scraper and which is contacted with the second toner collecting roller 105 to scrape off the reversely-charged toner adhered to the surface of the second toner collecting roller.

A negative voltage is applied to the second cleaning brush roller 104, and another negative voltage, whose absolute value is greater than that of the voltage applied to the second cleaning brush roller, is applied to the second toner collecting roller 105. In addition, the second toner cleaning portion 100*b* has a function of a polarity controller, which imparts a negative charge to the residual toner particles on the intermediate transfer belt 8 to control the residual toner particles so as to have the normal polarity (i.e., the negative polarity, in this case).

The third toner cleaning portion 100*c*, which is arranged on a downstream side from the second toner cleaning portion 100*b* relative to the belt moving direction BD, includes the third cleaning brush roller 107 serving as a normally-charged toner cleaning member to electrostatically remove normally charged toner particles; the third toner collecting roller 108, which serves as a normally-charged toner collecting member and which collects the toner adhered to the third cleaning brush roller 107; and a third scraping blade 109, which serves as a scraper and which is contacted with the third toner collecting roller 108 to scrape off the normally-charged toner adhered to the surface of the third toner collecting roller 108.

A positive voltage is applied to the third cleaning brush roller 107, and another positive voltage, which is greater than the positive voltage applied to the third cleaning brush roller, is applied to the third toner collecting roller 108.

The first cleaning portion 100*a* and the second cleaning portion 100*b* are separated from each other by a first insulating seal member 112, which is contacted with the first cleaning brush roller 101. Therefore, occurrence of problems such that discharging occurs between the first cleaning brush roller 101 and the second cleaning brush roller 104; and the toner collected by the second cleaning portion 100*b* is adhered again to the first cleaning brush roller 101 can be prevented.

The second cleaning portion 100*b* and the third cleaning portion 100*c* are separated from each other by a second insulating seal member 113, which is contacted with the second cleaning brush roller 104. Therefore, occurrence of problems such that discharging occurs between the second cleaning brush roller 104 and the third cleaning brush roller 107; and the toner collected by the third cleaning portion 100*c* is adhered again to the second cleaning brush roller 104 can be prevented.

In addition, at the exit of the belt cleaner 100, a third insulating seal member 114 is provided, which is contacted with the third cleaning brush roller 107. Therefore, occurrence of a problem such that discharging occurs between the third cleaning brush roller 107 and the tension roller 16 (illustrated in FIG. 1) can be prevented.

Further, the belt cleaner 100 includes an entrance seal 111, and a waste toner case (not shown). The waste toner case retains the toner collected by the second cleaning portion 100*b* and the third cleaning portion 100*c*. In addition, the waste toner case is detachably attached to the belt cleaner 100. Therefore, when a maintenance operation is performed, the waste toner case is detached from the belt cleaner 100 to dispose of the waste toner contained in the waste toner case.

In this belt cleaner 100, the toner collected by the second cleaning portion 100*b* and the third cleaning portion 100*c* is contained in the waste toner case. However, the belt cleaner 100 can have another configuration such that a feeding member to feed the collected toner to the first feeding screw 110*a* is provided at the bottom of the belt cleaner; or the bottom surface of the belt cleaner 100 is slanted toward the first feeding screw 110*a* so that the toner collected by the second and third cleaning portions 100*b* and 100*c* is fed to the waste toner tank provided on the main body of the printer by a second feeding screw 110*b*. Alternatively, the belt cleaner 100 may include another feeding screw to feed the toner collected by the second and third cleaning portions 110*b* and 110*c* to the waste toner tank provided on the main body of the printer.

Each of the cleaning brush rollers 101, 104 and 107 has a metal rotation shaft, which is rotatably supported, and a brush portion constituted of plural raised fibers (bristles) and provided on the outer periphery of the metal rotation shaft. The outer diameter of the brush rollers 101, 104 and 107 is from 15 mm to 16 mm.

The bristles have a double-layer (core-clad) structure such that electroconductive carbon is used for the inner portion of the fibers, and an insulating material such as polyester resins is used for the surface portion thereof. Therefore, the potential of the core portion of the bristles is substantially the same as the potential of the voltage applied to the cleaning brush rollers. Accordingly, the toner can be electrostatically attracted by the surface of the bristles of the brush rollers. Thus, the residual toner on the intermediate transfer belt 8 is electrostatically adhered to the bristles of the cleaning brush rollers 101, 104 and 107 due to the voltage applied to the cleaning brush rollers.

The structure of the bristles is not limited to the double-layer structure, and the bristles may be constituted only by an electroconductive material. In addition, the bristles may be provided on the rotation shaft so as to be slanted relative to the normal line of the rotation shaft (i.e., the brush rollers may have oblique bristles).

Further, it is possible that the double-layer bristles are used for the first cleaning brush roller 101 and the third cleaning brush roller 107, and bristles made only of an electroconductive material are used for the second cleaning brush roller 104. When bristles made of only an electroconductive material are used for the second cleaning brush roller 104, charges can be easily injected from the cleaning brush roller 104 into the toner, thereby making it possible to control the polarity of the toner on the intermediate transfer belt 8 so as to be the normal polarity (i.e., negative polarity in this case). When the double-layer bristles are used for the first cleaning brush roller 101 and the third cleaning brush roller 107, injection of charges into the toner can be prevented, thereby preventing occurrence of a problem in that the toner on the intermediate transfer belt 8 is reversely charged (i.e., the toner is positively charged). Using this method prevents occurrence of a problem in that toner particles, which cannot be electrostatically removed by the first cleaning brush roller 101 and the third cleaning brush roller 107, are formed on the intermediate transfer belt 8.

The cleaning brush rollers 101, 104 and 107 are contacted with the intermediate transfer belt 8 in such a manner that the length of the bristles of the brush rollers are 1 mm longer than the gap between the brush rollers and the intermediate transfer belt (i.e., the brushes are contacted with the intermediate transfer belt in a digging amount of 1 mm). Since the cleaning brush rollers 101, 104 and 107 are rotated by a driving device (not shown) in a direction opposite to the moving direction (BD) of the intermediate transfer belt 8 (i.e., the brush rollers counter the intermediate transfer belt), the velocity difference between the bristles of the brush rollers and the intermediate transfer belt can be increased. Therefore, chance of contact of a portion of the intermediate transfer belt 8 with the bristles of the brush rollers 101, 104 and 107 can be increased, thereby making it possible to satisfactorily remove the residual toner from the intermediate transfer belt 8.

A stainless steel (SUS) roller is used for the toner collecting rollers 102, 105 and 108 of the belt cleaner 100. However, the material of the toner collecting rollers is not limited thereto, and any materials can be used therefor as long as the toner collecting rollers 102, 105 and 108 can have a function of transferring the toner adhered to the cleaning brush rollers to the toner collecting rollers utilizing the potential difference between the bristles of the cleaning brush rollers and the toner collecting rollers.

For example, each of the toner collecting rollers 102, 105 and 108 can have a structure such that an electroconductive shaft is covered with a high-resistance elastic tube having a thickness of from a few micrometers to 100 μm or is coated with an insulating material, so that the resultant roller has a volume resistivity of from $10^{12}$ to $10^{14}$ Ω·cm.

Using a SUS roller for the toner collecting rollers 102, 105 and 108 has merits such that costs of the rollers can be reduced, and in addition the voltage to be applied to the rollers can be reduced, resulting in electric power saving.

In contrast, using a roller having a volume resistivity of from $10^{12}$ to $10^{14}$ Ω·cm for the toner collecting rollers 102, 105 and 108 has a merit such that when collecting the toner with the toner collecting rollers, injection of charges into the toner can be prevented, thereby preventing the toner from having the same polarity as that of the voltage applied to the toner collecting rollers, resulting in prevention of reduction of the toner collection rate.

The details of the cleaning brush rollers 101, 104 and 107 used for this belt cleaner 100 are as follows.

Material of brush: Electroconductive polyester (i.e., double-layer (core-clad) fiber in which the inner portion of the fiber includes electroconductive carbon, and the surface thereof is polyester resin)

Resistance of brush: $10^6$ to $10^8$Ω

Density of bristles in brush: 60,000 to 150,000 pieces/inch (i.e., 93 to 232.5 pieces/$mm^2$)

Diameter of bristles: about 25 μm to 35 μm

Lateral-buckling preventing treatment for brush: None

Diameter of brush roller: 14 mm to 20 mm

Setting position (digging amount) of brush rollers: The brush rollers are contacted with the intermediate transfer belt 8 in such a manner that the length of fibers is 1 to 1.5 mm longer than the gap between the brush rollers and the intermediate transfer belt (i.e., the brush rollers are contacted with the intermediate transfer belt 8 in a digging amount of from 1 to 1.5 mm).

The voltage applied to the first cleaning brush roller 101 is set to a voltage at which cleaning can be satisfactorily performed even when a large amount of non-transferred toner image is adhered to the intermediate transfer belt 8.

The voltage applied to the second cleaning brush roller 104 is set to a relatively high voltage so that charges can be injected into the residual toner on the intermediate transfer belt 8. The conditions such as density of bristles in the brush, resistance of the brush, diameter of the bristles, applied voltage, material of the bristles, setting position (digging amount) of the cleaning brush rollers are not limited thereto, and can be optimized depending on the system for which the cleaning brush rollers are used. Suitable materials for use as the bristles include nylon, acrylic resins, and polyester.

The conditions of the toner collecting rollers 102, 105 and 108 are as follows.

Material of core of rollers: SUS303

Setting position (digging amount) of toner collecting rollers: The toner collecting rollers are contacted with the brush rollers in such a manner that the length of bristles of the brush is 1 to 1.5 mm longer than the gap between the toner collecting rollers and the corresponding cleaning brush rollers.

Since the conditions such as material of the toner collecting rollers, setting of the toner collecting rollers, and the applied voltage can be optimized depending on the system for which the toner collecting rollers are used, the conditions are not limited to the above-mentioned conditions.

The conditions of the scraping blades 103, 106 and 109 are as follows.

Material of blades: SUS304

Contact angle of blades: 20°

Thickness of blades: 0.1 mm

Setting position (digging amount) of blades: The blades are contacted with the corresponding toner collecting rollers in such a manner that the length of the blade is 0.5 to 1.5 mm longer than the gap between the blades and the corresponding toner collecting rollers.

Since the conditions such as contact angle, thickness of blades, and setting of blades can be optimized depending on the system for which the blades are used, the conditions are not limited to the above-mentioned conditions.

Next, the operation of the belt cleaner will be described.

Referring to FIG. 5, when removing residual toner particles on the intermediate transfer belt 8, initially the voltages applied to the first cleaning brush roller 101 and the first toner collecting roller 102 are determined. Specifically, the power control member 131*a* of the cleaning power source 131 performs constant current control on the power output member 131*b* at a predetermined time, so that a predetermined amount of current flows through the first cleaning brush roller 101. In addition, the power control member 132*a* of the cleaning power source 132 performs constant current control on the power output member 132*b* at the predetermined time, so that a predetermined amount of current flows through the first toner collecting roller 102. Thus, predetermined amounts (proper amounts) of currents flow through the first cleaning brush roller 101 and the first toner collecting roller 102. In this regard, the voltages applied to the first cleaning brush roller 101 and the first toner collecting roller 102 are detected. Depending on the detection results, the voltages to be applied to the first cleaning brush roller 101 and the first toner collecting roller 102 are determined as the detected voltages. The power output member 131*b*, on which the power controlling member 131*a* performs constant voltage control, outputs the thus determined voltage to the first cleaning brush roller 101, and the power output member 132*b*, on which the power controlling member 132*a* performs constant voltage control, outputs the thus determined voltage to the first toner collecting roller 102.

The values of currents to be flowed through the first cleaning brush roller 101 and the first toner collecting roller 102 when determining the voltages to be applied to the first cleaning brush roller and the first toner collecting roller are preliminarily determined by experiments. Specifically, the value of current to be flowed through the first cleaning brush roller 101 is the value of current flowing through the first cleaning brush roller 101 and the intermediate transfer belt 8 when a voltage suitable for the first cleaning brush roller to clean the intermediate transfer belt bearing residual toner particles thereon is applied to the first cleaning brush roller, which bears no toner particles thereon. In addition, the value of current to be flowed through the first toner collecting roller 102 is the value of current flowing through the first cleaning brush roller 101 (which bears no toner particles) and the first toner collecting roller 102 when a voltage suitable for the first toner collecting roller to collect toner particles on the first cleaning brush roller is applied to the first toner collecting roller.

When removing non-transferred toner images on the intermediate transfer belt 8, the power output member 131*b* is subjected to constant current control according to a control signal output from the power control member 131*a* so that the predetermined amount of current flows through the first cleaning brush roller 101, and the power output member 132*b* is subjected to constant current control according to a control signal output from the power control member 132*a* so that the predetermined amount of current flows through the first toner collecting roller 102. Thus, currents suitable for the first cleaning brush roller 101 and the first toner collecting roller 102 flow through the rollers.

In this regard, the total amounts of the currents flowing through the first cleaning brush roller 101 and the first toner collecting roller 102 is the amount of current flowing from the first cleaning brush roller to the intermediate transfer belt 8 when removing non-transferred toner images. The present inventors found that the current flowing from the first cleaning brush roller 101 to the intermediate transfer belt 8 largely affects the cleanability of the first cleaning brush roller. Therefore, in this disclosure, the current flowing from the first cleaning brush roller 101 to the intermediate transfer belt 8 is detected, and the power output members 131*b* and 132*b* are controlled by the power control members 131*a* and 132*a* so that a proper current flows from the first cleaning brush roller to the intermediate transfer belt, thereby making it possible for the first cleaning brush roller to obtain good cleanability.

In this regard, the values of currents flowed through the first cleaning brush roller 101 and the first toner collecting roller 102 are preliminarily determined by experiments. The value of current to be flowed through the first cleaning brush roller 101 is the value of current flowing through the first cleaning brush roller 101 and the intermediate transfer belt 8 when a voltage suitable for the cleaning brush roller to clean the intermediate transfer belt bearing a non-transferred toner image thereon is applied to the first cleaning brush roller, which bears no toner particles (non-transferred toner image) thereon. In addition, the value of current to be flowed through the first toner collecting roller 102 is the value of current flowing through the first cleaning brush roller 101 (which bears no toner particles) and the first toner collecting roller 102 when a voltage suitable for the first toner collecting roller to collect toner particles on the first cleaning brush roller is applied to the first toner collecting roller.

As illustrated in FIG. 5, after passing the secondary transfer portion (i.e., the nip between the rollers 12 and 18 illustrated in FIG. 1), the residual toner particles (i.e., toner particles remaining on the intermediate transfer belt even after the transferring process) and non-transferred toner images (such as patterned toner images) present on the intermediate transfer belt 8 are fed by the rotated intermediate transfer belt so as to pass through the entrance seal 111, and then fed to the position, at which the residual toner particles and the non-transferred toner images face the first cleaning brush roller 101.

In this regard, a voltage with a polarity (positive polarity, in this case) opposite to the polarity (negative polarity) of the normal toner particles is applied to the first cleaning brush roller 101, thereby forming an electric field between the intermediate transfer belt 8 and the first cleaning brush roller 101 due to potential difference therebetween. Therefore, negatively-charged toner particles of the residual toner particles and the non-transferred toner images on the intermediate transfer belt 8 are electrostatically adhered to the first cleaning brush roller 101.

The negatively-charged toner particles adhered to the first cleaning brush roller 101 are fed by the rotated first cleaning brush roller to the contact portion of the first cleaning brush roller with the first toner collecting roller 102, to which a positive voltage higher than the voltage applied to the first cleaning brush roller 101 is applied.

Therefore, the toner particles on the first cleaning brush roller 101 are electrostatically transferred onto the first toner collecting roller 102 due to the electric filed formed by the difference in potential between the first cleaning brush roller and the toner collecting roller.

The negatively-charged toner particles thus transferred onto the first toner collecting roller 102 are scraped off by the first scraping blade 103, and the toner particles thus scraped off are discharged from the belt cleaner 100 by the feeding screw 110*a*.

Toner particles (such as negatively- or positively-charged toner particles of the non-transferred toner image, and positively-charged residual toner particles), which remain on the intermediate transfer belt 8 without being removed by the first cleaning brush roller 101, are fed to the second cleaning brush roller 104.

Since a voltage having the same polarity (negative polarity in this case) as that of the normal toner particles is applied to the second cleaning brush roller 104, charge injection or discharging is caused between the second cleaning brush roller 104 and the toner particles, and thereby the toner particles are allowed to have a negative polarity.

In addition, toner particles, which maintain a positive charge even after the charge injection or discharging, are electrostatically adhered to the second cleaning brush roller 104 due to the electric field formed by the difference in potential between the cleaning brush roller 104 and the intermediate transfer belt 8.

The positively-charged toner particles adhered to the second cleaning brush roller 104 are fed by the rotated second cleaning brush roller to the contact portion of the second cleaning brush roller with the second toner collecting roller 105, to which a negative voltage greater (in absolute value) than the voltage applied to the second cleaning brush roller is applied.

The toner particles on the second cleaning brush roller 104 are electrostatically transferred onto the second toner collecting roller 105 due to the electric filed formed by the difference in potential between the second cleaning brush roller and the second toner collecting roller.

The positively-charged toner particles thus transferred onto the second toner collecting roller 105 are scraped off by the second scraping blade 106.

Toner particles (such as negatively-charged toner particles), which remain on the intermediate transfer belt 8 without being removed by the first cleaning brush roller 101 and the second cleaning brush roller 104, are fed to the third cleaning brush roller 107.

In this regard, the toner particles fed to the third cleaning brush roller 107 have been allowed to have a negative charge by the second cleaning brush roller 104. Since substantially all the toner particles on the intermediate transfer belt 8 have been removed therefrom by the first and second cleaning brush rollers 101 and 104, the amount of toner particles fed to the third toner cleaning brush roller 107 is very small.

The small amount of toner particles remaining on the intermediate transfer belt 8 are electrostatically adhered to the third cleaning brush roller 107, and then transferred onto the third toner collecting roller 108. The transferred toner particles are scraped off the third toner collecting roller 108 by the third scraping blade 109.

Thus, in the belt cleaner 100, a greater part of the negatively-charged toner particles constituting the non-transferred toner image on the intermediate transfer belt 8 are removed by the first cleaning brush roller 101, and therefore the amount of toner particles fed to the second and third cleaning brush rollers 104 and 107 can be reduced.

The toner particles fed to the third cleaning brush roller 107 are toner particles, which have not been removed by the first and second cleaning brush rollers 101 and 104. Therefore, the amount of toner particles fed to the third cleaning brush roller 107 is very small. In addition, the toner particles fed to the third cleaning brush roller 107 are negatively charged by the second cleaning brush roller 104, and therefore the toner particles can be satisfactorily removed by the third cleaning brush roller 107. Therefore, even when a non-transferred toner image including a large amount of toner particles is formed on the intermediate transfer belt 8, the toner image can be satisfactorily removed from the intermediate transfer belt 8. In addition, residual toner particles, whose amount is less than that of the non-transferred toner image, can be satisfactorily removed by these three cleaning brush rollers 101, 104 and 107.

In this belt cleaner 100, the second cleaning brush roller 104 removes reversely (positively) charged toner particles on the intermediate transfer belt 8. However, the second cleaning portion 100*b* can be replaced with a polarity controller, which controls the polarity of toner particles on the intermediate transfer belt 8 without removing the positively-charged toner particles. In this case, the toner particles on the intermediate transfer belt 8 are allowed to have a negative polarity by the polarity controller, and the negatively-charged toner particles are fed to the third cleaning brush roller 107 by the rotated intermediate transfer belt. The thus fed negatively-charged toner particles are removed by the third cleaning brush roller 107. Suitable devices for use as the polarity controller include electroconductive brushes, electroconductive blades and corona chargers.

The polarity of the toner particles controlled by the polarity controller is not limited to the negative polarity, and can be the positive polarity. In this case, a cleaning brush roller, to which a negative voltage is applied, is arranged on a downstream side from the polarity controller relative to the moving direction (BD) of the intermediate transfer belt 8 to remove the positively charged toner particles from the intermediate transfer belt 8.

Even in such a belt cleaner, toner particles of the non-transferred toner image can be roughly removed by the first cleaning brush roller 101, and therefore the amount of toner particles fed to the polarity controller is small. Therefore, the polarity controller can control the toner particles remaining on the intermediate transfer belt 8 to have a predetermined polarity, thereby making it possible to electrostatically remove the toner particles having the predetermined polarity with the cleaning brush roller provided on the downstream side from the polarity controller. Accordingly, even when a non-transferred toner image, which includes a large amount of toner particles, is fed to the belt cleaner 100, the toner particles can be satisfactorily removed from the intermediate transfer belt 8.

The above description has been made assuming that the intermediate transfer belt 8 has a multi-layered structure. However, even when the intermediate transfer belt 8 has a single-layered structure (i.e., the belt consists of a base layer) and the toner is a spherical toner, which typically has bad cleanability, the cleaner of this disclosure can be preferably used therefor. In addition, the cleaner of this disclosure is not limited to cleaning of such an intermediate transfer belt, and can be used for cleaning any image carriers such as photoreceptor drums. Namely, the cleaner is not limited to cleaning of an elastic belt.

Figure 6:
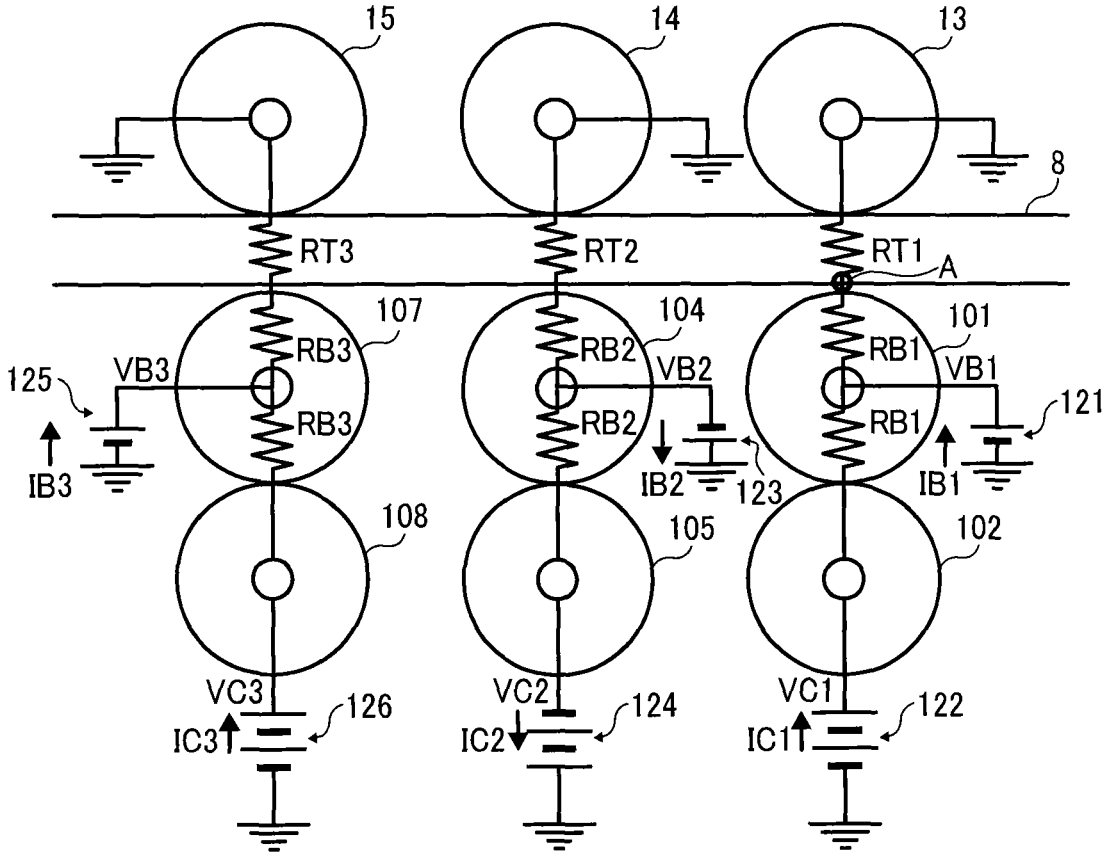
FIG. 6 is a schematic view illustrating an equivalent circuit of the belt cleaner illustrated in FIG. 5.

FIG. 6 is a schematic view illustrating an equivalent circuit of the belt cleaner 100 illustrated in FIG. 5.

The currents flowing through cleaning portions, in which toner is transferred from the intermediate transfer belt 8 to the first, second and third cleaning brush rollers 101, 104 and 107, are the cleaning current contributing to cleaning. For example, in the first cleaning portion 100*a*, the current flowing through a point A (i.e., the contact point of the first cleaning brush roller 101 with the intermediate transfer belt 8) illustrated in FIG. 6 is the cleaning current. The current is the total of a current (IB1) and a current (IC1), which are detected by current detectors of power sources 121 and 122 (which respectively apply a voltage to the first cleaning brush roller 101 and the first toner collecting roller 102), respectively. Similarly, in the second cleaning portion 100*b*, the cleaning current contributing to cleaning is the total of a current (IB2) and a current (IC2), which are detected by current detectors of power sources 123 and 124 (which respectively apply a voltage to the second cleaning brush roller 104 and the second toner collecting roller 105), respectively. Similarly, in the third cleaning portion 100*c*, the cleaning current contributing to cleaning is the total of a current (IB3) and a current (IC3), which are detected by current detectors of power sources 125 and 126 (which respectively apply a voltage to the third cleaning brush roller 107 and the third toner collecting roller 108), respectively.

In this belt cleaner, change of setting of the applied voltage for removing toner is performed as follows. Specifically, when the intermediate transfer belt 8 and the belt cleaner 100 are driven and toner is not yet fed to the belt cleaner, the six power sources 121-126 respectively apply predetermined voltages to the first cleaning brush roller 101, the first toner collecting roller 102, the second cleaning brush roller 104, the second toner collecting roller 105, the third cleaning brush roller 107, and the third toner collecting roller 108.

When the setting of the voltage applied to the first cleaning brush roller 101 is changed, the current flowing through the contact point of the first cleaning brush roller 101 with the intermediate transfer belt 8 (i.e., the currents IB1 and IC1 flowing through the power sources 121 and 122) is detected. The voltage to be applied to the first cleaning brush roller 101 is determined as a voltage at which the total of the currents IB1 and IC1 becomes the targeted current, and the setting of the voltage to be applied to the first cleaning brush roller is changed based on the result. After changing the setting of the applied voltage, the set voltage is applied to the first cleaning brush roller 101.

In FIG. 6, characters RT1, RT2 and RT3 denote the resistance of the portion of the intermediate transfer belt 8 sandwiched by the first cleaning brush roller 101 and the first cleaner counter roller 13, the resistance of the portion of the intermediate transfer belt sandwiched by the second cleaning brush roller 104 and the second cleaner counter roller 14, and the resistance of the portion of the intermediate transfer belt sandwiched by the third cleaning brush roller 107 and the third cleaner counter roller 15, respectively. Characters RB1, RB2 and RB3 respectively denote the resistance of the brush portion of the first cleaning brush roller 101, the resistance of the brush portion of the second cleaning brush roller 104, and the resistance of the brush portion of the third cleaning brush roller 107. Characters VB1, VB2 and VB3 respectively denote the voltages applied to the first, second and third cleaning brush rollers 101, 104 and 107. Characters VC1, VC2 and VC3 respectively denote the voltages applied to the first, second and third toner collecting rollers 102, 105 and 108.

Having generally described this invention, further understanding can be obtained by reference to certain specific examples which are provided herein for the purpose of illustration only and are not intended to be limiting.

Example 1

An example of the cleaner of this disclosure will be described.

As mentioned above, the first cleaning portion 100*a* includes the first cleaning brush roller 101 and the first toner collecting roller 102. The second cleaning portion 100*b* includes the second cleaning brush roller 104 and the second toner collecting roller 105. The third cleaning portion 100*c* includes the third cleaning brush roller 107 and the third toner collecting roller 108. In addition, the cleaner further includes power sources to respectively apply bias voltages to these rollers. Hereinafter, this example will be described by reference to the first cleaning portion 100*a* for the sake of shorthand.

In this example, the current flowing from the power source to the first cleaning brush roller 101 is hereinafter referred to as a current IB1, and the current flowing from the corresponding power source to the first toner collecting roller 102 is hereinafter referred to as a current IC1. In addition, the voltage applied to the first cleaning brush roller 101 by the corresponding power source 121 is hereinafter referred to as the voltage VB1, and the voltage applied to the first toner collecting roller 102 by the power source 122 is hereinafter referred to as the voltage VC1. The bias applied to the cleaning brush roller is a bias (hereinafter referred to as a cleaning bias), by which a potential difference is formed between the cleaning brush roller and a member to be cleaned (i.e., the intermediate transfer belt in this case) to electrostatically collect toner on the member. In addition, a bias (hereinafter referred to as a collection bias) greater than the cleaning bias in absolute value is applied to the toner collecting roller to transfer the toner from the cleaning brush roller to the toner collecting roller. The waste toner collected by the toner collecting roller is fed to a waste toner feeding passage.

Each of the cleaning brush rollers and toner collecting rollers has an arbitrary setup bias value. In this regard, when the power source is a constant current control power source, the setup bias is the targeted current, and when the power source is a constant voltage control power source, the setup bias is the targeted voltage. In this example, any one of the constant current control power source and the constant voltage control power source is available. Hereinafter, description will be made by reference to a case using a constant voltage control power source.

It is preferable that the setup bias is determined to be a bias by which toner can be satisfactorily removed by the cleaning brush roller while the toner on the cleaning brush roller can be satisfactorily collected by the toner collecting roller. The method for determining the setup bias value is not particularly limited, and for example, a method in which the setup bias is preliminarily determined by experiments, or a method using a feedback control can be used. In this example, the setup bias determining method is not specified, and description is made while assuming that the cleaning brush roller has a targeted voltage VBn_t, and the toner collecting roller has a targeted voltage VCn_t, wherein n is 1, 2 or 3.

The most typical bias waveform and a real bias waveform of the bias applied to each roller will be described.

Figure 7:
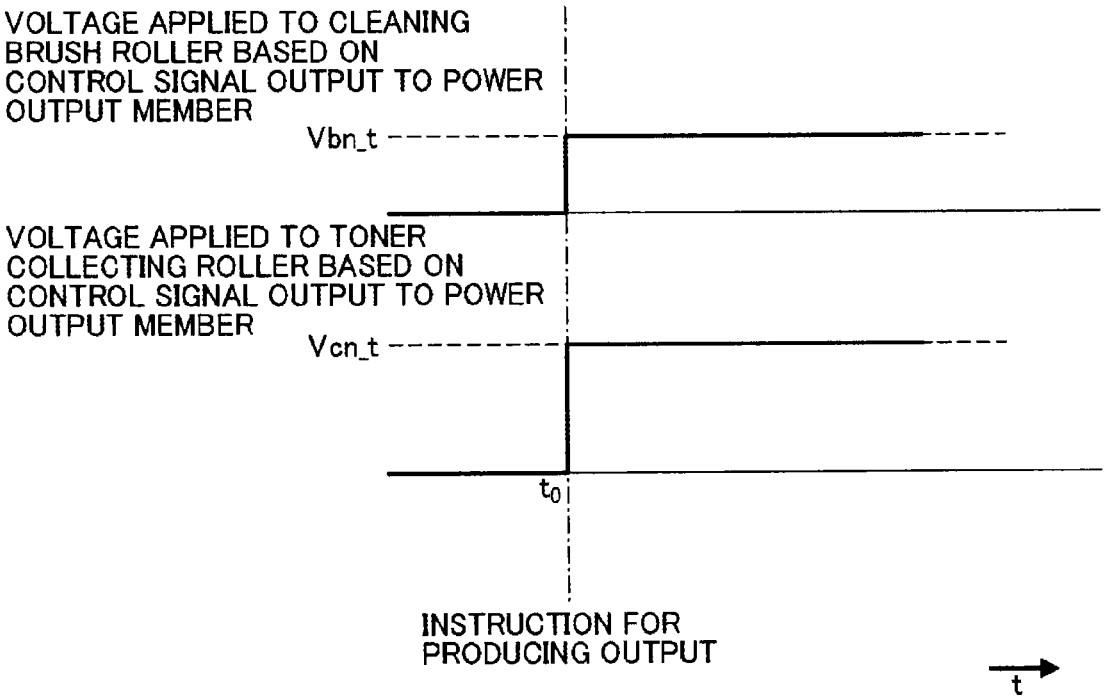
FIG. 7 RELATED ART
FIG. 7 is a schematic view for describing the most typical waveforms of biases applied to a cleaning brush roller and a toner collecting roller of the belt cleaner.

FIG. 7 is a schematic view illustrating the most typical waveform of the bias applied to each of the cleaning brush roller and the toner collecting roller. Referring to FIG. 7, when a central processing unit (CPU) of the belt cleaner provides instruction for producing output at a time $t_0$ to each of the power sources, the power control members 131*a*, 132*a*, 133*a*, 134*a*, 135*a* and 136*a* (illustrated in FIG. 5) output control signals (pulse width modulation (PWM) signals) to the power output members 131*b*, 132*b*, 133*b*, 134*b*, 135*b* and 136*b* (illustrated in FIG. 5), respectively. In this regard, the power output members output the targeted applied voltages at substantially the same time.

However, in reality it takes a time of tens of milliseconds until the applied voltage reaches the targeted voltage. In addition, it is often the case that the activation timing of the power source delays by a few milliseconds to tens of milliseconds due to the individual difference of the power source. One example of the case is illustrated in FIG. 8.

Figure 8:
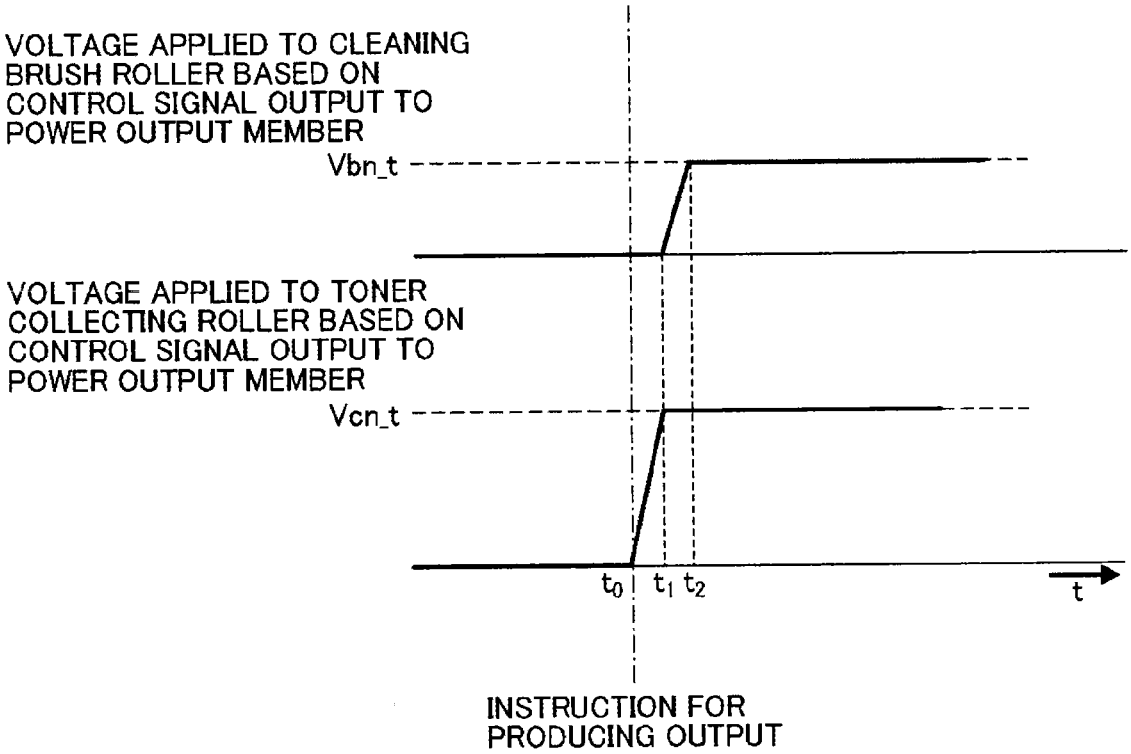
FIG. 8 RELATED ART
FIG. 8 is a schematic view for describing the real waveforms of biases at the rise time when a power source applies the biases to the cleaning brush roller and the toner collecting roller.

In the waveform chart illustrated in FIG. 8, the leading edge of the bias is described as a line for the sake of simplification. Referring to FIG. 8, the power output member of the power source for the toner collecting roller starts to output a voltage Vcn at a time $t_0$ based on the instruction for producing output from the corresponding power control member, and the voltage reaches the targeted applied voltage Vcn_t at a time $t_1$. At the time $t_1$, the power output member of the power source for the cleaning brush roller starts to output a voltage Vbn based on the instruction for producing output from the corresponding power control member, and the voltage reaches the targeted applied voltage Vbn_t at a time $t_2$. Namely, in this case, the voltage Vcn from the power output member for the toner collecting roller rises before the voltage Vbn from the power output member for the cleaning brush roller rises, and the voltage Vcn reaches the targeted applied voltage Vcn_t before the voltage Vbn reaches the targeted applied voltage Vbn_t, resulting in formation of a potential difference between the cleaning brush roller and the toner collecting roller.

If the waveform is the waveform illustrated in FIG. 8, the voltage Vcn for the toner collecting roller reaches the targeted applied voltage Vcn_t at the time $t_1$ in which the voltage Vbn for the cleaning brush roller starts to rise, and therefore the potential different is Vcn_t, which is maximum in this case. Therefore, a current, which depends on the resistance between the cleaning brush roller and the toner collecting roller, flows from the power source for the cleaning brush roller to the power source of the toner collecting roller. This current is referred to as an inflowing current. Since the voltages Vcn and Vbn have the same polarity, the inflowing current apparently has a polarity opposite to the polarity of current that the power sources output. Specifically, when the power sources for the cleaning brush roller and the toner collecting roller are positive power sources, a plus current flows into the power source for the toner collecting roller. Since the function of the toner collecting roller is to flow a plus current in this case, the current inflowing direction is opposite to the current outputting direction. Therefore, when such an inflowing current flows, the power source for the toner collecting roller often causes defective activation. Namely, since a current, which does not flow into the power source under normal conditions, flows, the circuit of the power source does not operate as intended.

In general, in order to prevent occurrence of such a problem, power sources are equipped with a protective circuit so that the power sources can be activated even when a certain amount of inflowing current flows thereinto. However, when the inflowing current is greater than the guaranteed inflowing current, activation of the power source is not guaranteed. In order to securely activate a power source even when a large inflowing current flows, a special circuit is necessary, and therefore the cost of the power source seriously increases.

When it is tried to prevent formation of the inflowing current at the side of the cleaning member, it is necessary to change the resistance of the cleaning brush roller, the targeted applied voltage, and/or the resistance of the member to be cleaned. Therefore, the cleaner cannot perform the original function in this case.

When a cleaner and a power source, which do not take a measure for the inflowing current, are used and the inflowing current is relatively large, the image forming apparatus is operated while the power source for the toner collecting roller is defectively activated, thereby making it impossible to apply the voltage to the toner collecting roller. In this case, the toner collecting roller cannot collect the toner on the cleaning brush roller, and defective cleaning is caused when the amount of the toner on the cleaning brush roller increases to an extent such that the cleaning brush roller cannot bear the toner thereon. In the reverse case in which the power source for the brush cleaning roller is not activated due to an inflowing current, a bias is not applied to the cleaning brush roller, thereby making it impossible for the cleaning brush roller to perform electrostatic cleaning, resulting in defective cleaning. Therefore, it is essential to securely activate the power sources in order to impart high reliability to the cleaner.

In this example (Example 1), the below-mentioned power rising operation is performed to securely prevent defective cleaning caused by defective activation of the power sources due to the inflowing current without using an expensive power source (i.e., a power source equipped with a protective circuit protecting the power source from a large inflowing current) and without applying restriction on the cleaning member to prevent defective cleaning caused by the inflowing current.

Figure 9:
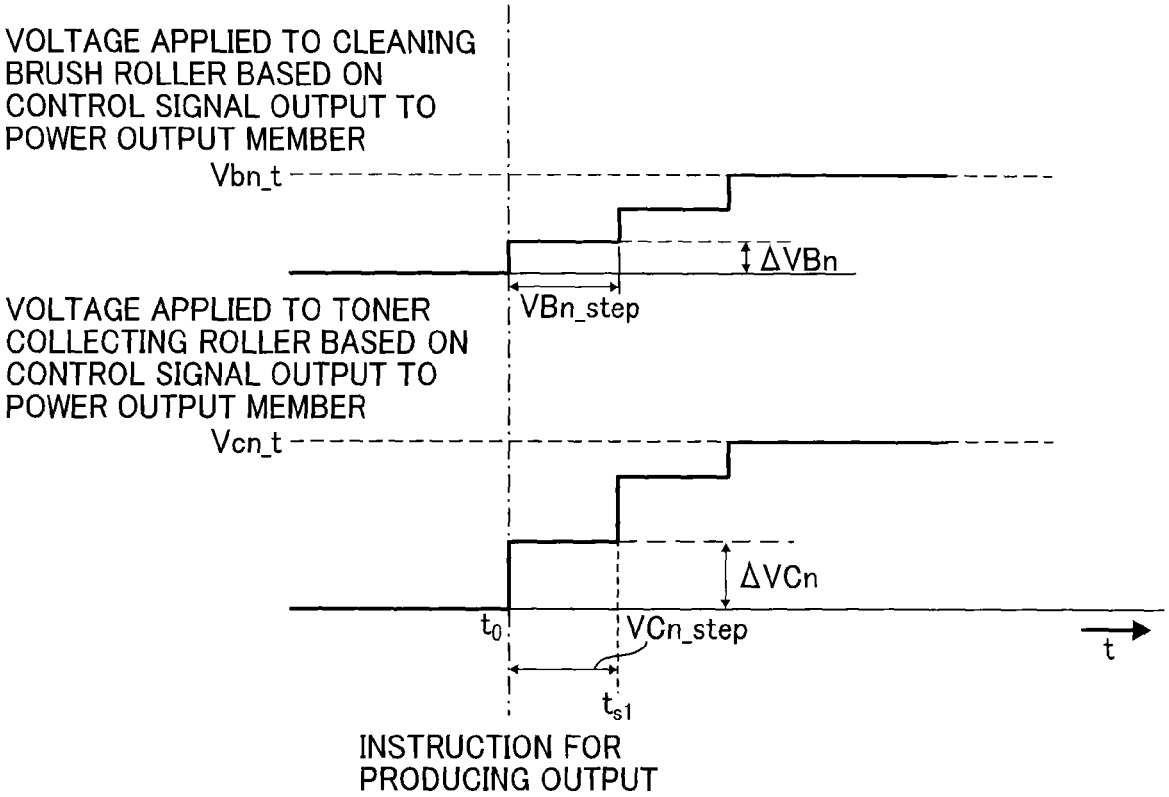
FIG. 9 is a waveform chart for describing an example of the control sequence in the bias-rising time.

FIG. 9 is a waveform chart for describing the control sequence at the bias-rising time in Example 1.

In Example 1, the voltage of a control signal, which concerns the applied voltage (bias) and which is output from the power control member to the power output member of the power source for the corresponding roller, is changed so that the applied voltage is changed in several levels. Namely, the control signal is changed such that the applied voltage is changed stepwise. As illustrated in FIG. 9, the change of voltage applied to the cleaning brush roller or the toner collecting roller is ΔVBn or ΔVCn per one step, and the time period of one step (i.e., a time period of form $t_0$ to $t_{s1}$) is VBn_step or VCn_step. In this case, the potential difference between the bias to the cleaning brush roller and the bias to the toner collecting roller in a n-th step falls within (ΔVCn−ΔVBn)×n. The maximum value of the targeted voltage (i.e., the targeted final value of the applied voltage) for the toner collecting roller is VCn_t, and the maximum value of the targeted voltage (i.e., the targeted final value of the applied voltage) for the cleaning brush roller is VBn_t, and the voltage in the n-th step is not greater than the maximum value. Therefore, the potential difference between the cleaning brush roller and the toner collecting roller is always relatively small compared to the case illustrated in FIG. 8 in which the voltage simply rises by one step, thereby decreasing the inflowing current. The values of the voltage in the stepwise voltage changing process are hereinafter referred to as intermediate values of the applied voltage.

Figure 10:
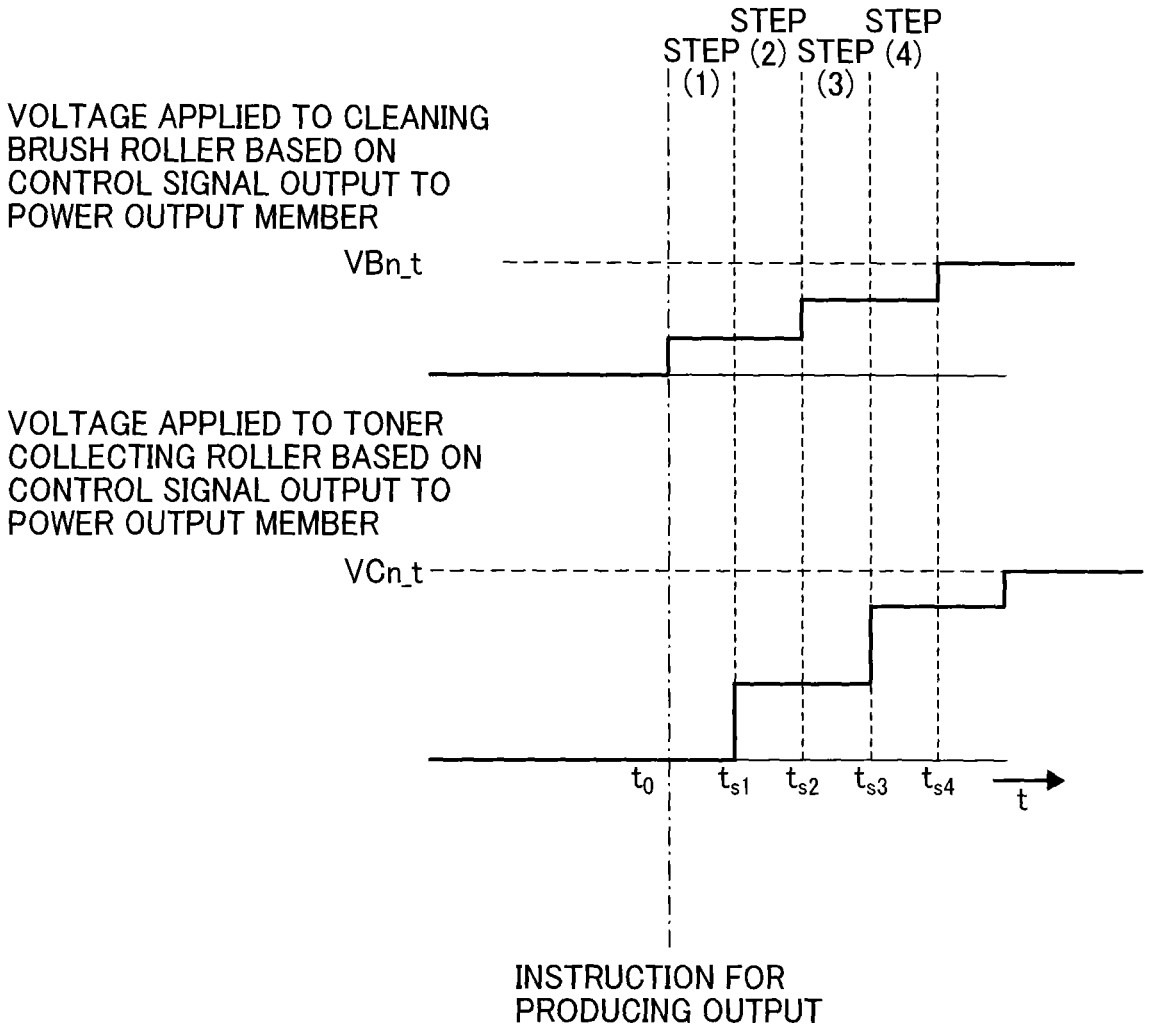
FIG. 10 is a schematic view illustrating waveforms of biases differing from each other in the bias-rising time.

FIG. 10 is a schematic view illustrating waveforms of biases having different bias-rising times. In FIG. 10, STEPs (1)-(4) respectively represent periods of time of from $t_0$ to $t_{s1}$, from $t_{s1}$ to $t_{s2}$, from $t_0$ to $t_0$, and from $t_0$ to $t_{s4}$. In each of STEPs (1)-(4), the potential difference between the cleaning brush roller and the toner collecting roller is the following.

STEP (1): −ΔVBn

STEP (2): ΔVCn−ΔVBn

STEP (3): ΔVCn−ΔVBn×2

STEP (4): (ΔVCn−ΔVBn)×2

Thus, the potential difference (bias) repeatedly takes values of ΔVCn×(m−1)−ΔVBn×m, and (ΔVCn−ΔVBn)×m (m=1, 2, 3 . . . ), and finally reaches a value, ΔVCn_t−ΔVBn_t. In this regard, a relationship, (ΔVCn−ΔVBn)×m<ΔVCn_t−ΔVBn_t, is satisfied. Namely, in each state including the transient state, the following relationship is satisfied:

$$\Delta VCn\times(m-1)-\Delta VBn\times m=(\Delta VCn-\Delta VBn)\times(m-1)-\Delta VBn<(\Delta VCn_t-\Delta VBn_t)-\Delta VBn.$$

Therefore, even when a time lag is caused between the bias-rising times for the cleaning brush roller and the toner collecting roller due to the individual difference of the power sources, the potential difference between the cleaning brush roller and the toner collecting roller can be controlled so as to be decreased, thereby decreasing the inflowing current at any time.

In FIG. 10, the biases ideally rise in each of STEPs (1)-(4). When the biases have such a slanting leading edge as illustrated in FIG. 8, the potential difference further decreases, thereby causing no problem. In reality, the bias has a slightly-slanting leading edge, and typically has a curved leading edge.

Next, ΔVBn, ΔVCn, VBn_step and VCn_step will be described in detail.

The variation of voltage of the biases, ΔVCn and ΔVBn, is set to a value at which the inflowing current flowing into the power source is not greater than the guaranteed inflowing current of the power source. Specifically, even when only ΔVBn is applied in STEP (1) (illustrated in FIG. 10), the other power source (the power source for the toner collecting roller) can be securely activated. Therefore, it is most effective. In a case of constant current control, a simple method in which the variation is set to a value not greater than the warranted activation current of the power source can be used. In this example, which performs constant voltage control, the voltage is set to a value not greater than the voltage by which a current not greater than the warranted activation current of the power source flows even when the resistance of the brush roller is minimum.

Next, the time period of one step, VBn_step and VCn_step, will be described.

In this example, the time period VBn_step is the same as the time period VCn_step, and VBn_step is set to a time equal to the rising time of the power source, which is defined as a time period of from power-on of the power source to a time at which the output voltage reaches the targeted voltage (alternatively, a time period of from a time at which the output voltage is 10% of the targeted voltage to a time at which the output voltage is 90% of the targeted final voltage). The rising time is one of popular items of specifications of power sources. Since the time period of one step (VBn_step) is set to the rising time of the power source, the bias reaches the targeted bias in each step. In other words, it is meaningless that the time period of one step is set to a time longer than the rising time of the power source. By using this method, the time period of one step can be shortened according to the ability of the power source, thereby making it possible to reduce the operating time. Namely, it is most effective to set the time period VBn_step to a time not longer than the rising time of the power source.

Hereinbefore, the effective setting of each parameter has been described. However, the parameters are arbitrary control parameters, and therefore setting of the parameters can be freely performed. Namely, even when the parameters are set to values different from the values mentioned above, a certain level of effect can be produced. In addition, hereinbefore description has been made that no problem is caused even in a case in which the bias VCn rises after the bias VBn, and the same is true for the opposite case in which the bias VBn rises after the bias VCn.

Referring to FIG. 10, it is possible that the variation of the bias, ΔVCn and ΔVBn, is less than the predetermined value in the final step (i.e., the step in which the bias reaches VBn_t or VCn_t). Namely, the variation of the bias, ΔVCn and ΔVBn, is not necessarily the same. In FIG. 10, the variation ΔVCn in the third (final) step is smaller than the variation ΔVCn in the first and second steps.

Example 2

Another example of the cleaner of this disclosure will be described.

In Example 1 above, it is assumed that the power source connected to the toner collecting roller and the power source connected to the cleaning brush roller are started up at the same time, and even when the timing of power-on of the power sources is different, the amount of inflowing current is controlled so as to be not greater than the predetermined amount to securely activate the power sources.

In Example 2, not only the absolute value of the potential difference (i.e., inflowing current) between the cleaning brush roller and the toner collecting roller is controlled, but also the cleaner has a configuration intended to perform the original toner collection function. Specifically, the timing of power-on of the power source connected with the toner collecting roller is intentionally differentiated from the timing of power-on of the power source connected to the cleaning brush roller, and the power source for the toner collecting roller is initially turned on.

Figure 11:
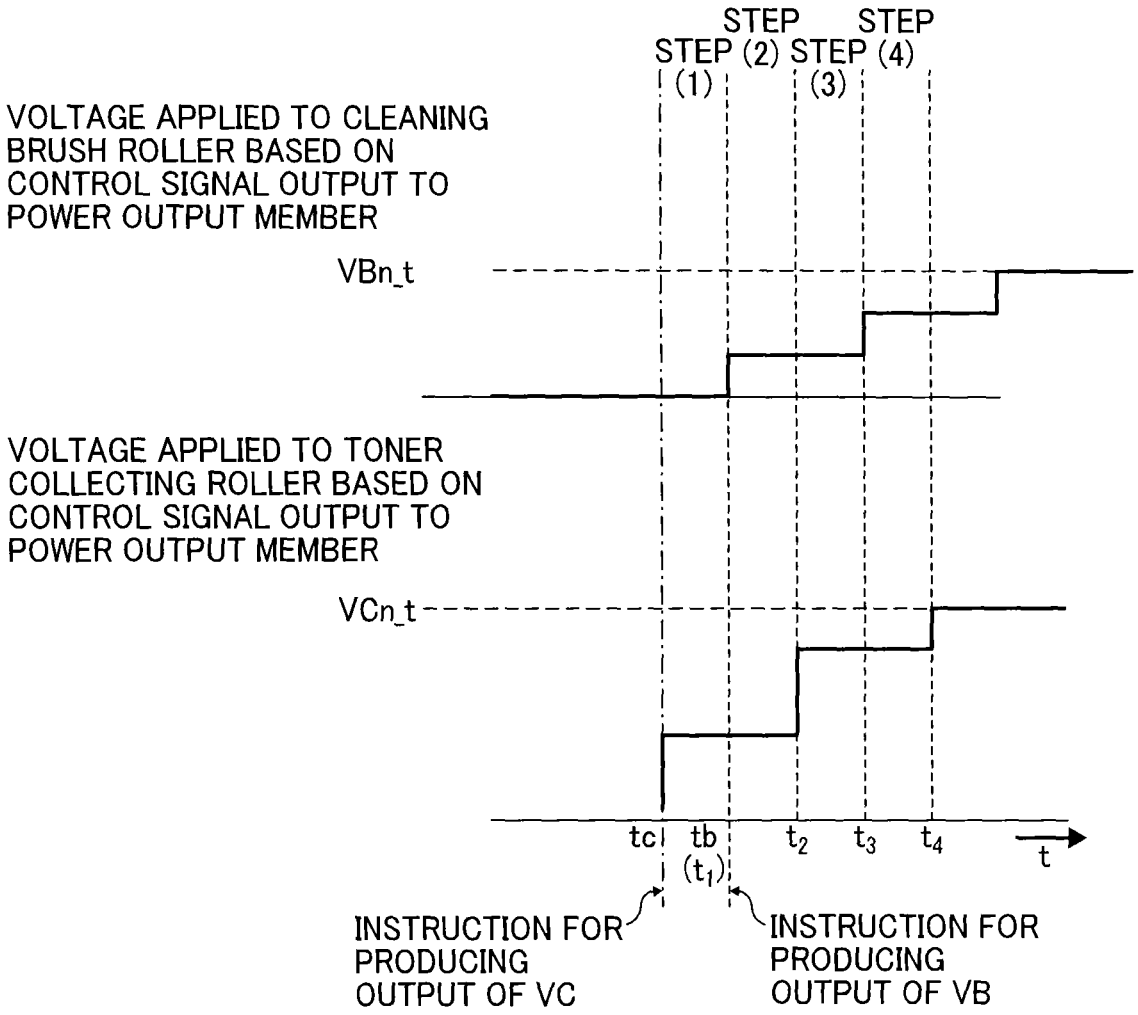
FIG. 11 is a waveform chart for describing another example of the control sequence in the bias-rising time.

FIG. 11 is a waveform chart for describing the control sequence at the bias-rising time in Example 2.

Such a cleaner as having a cleaning brush roller and a toner collecting roller intends that a relatively high voltage is applied to the toner collecting roller compared to the voltage applied to the cleaning brush roller to transfer the toner on the cleaning brush roller to the toner collecting roller. Therefore, by controlling the potential of the toner collecting roller to be higher than that of the cleaning brush roller at the rising time, the residual toner remaining on the cleaning brush roller in the last cleaning operation can be collected by the toner collecting roller. When the power sources are started up at the same time (Example 1), or the power source for the cleaning brush roller is initially started up, toner cannot be collected until the control signal from the power control member for the cleaning brush roller and the control signal from the power control member for the toner collecting roller reach the voltages corresponding to the targeted final value of the applied voltages, rather, a bias is applied in such a direction that the toner is held by the cleaning brush roller. In this case, a problem in that the toner is fixed to the cleaning brush roller is often caused.

Therefore, in Example 2, the power-on timings of the rollers are intentionally differentiated from each other to perform control such that the voltage of the control signal sent from the power control member of the power source for the toner collecting roller is always higher than that for the cleaning brush roller. Accordingly, occurrence of a problem such that the cleaning brush roller holds a large amount of toner, and a problem which occurs at the start of the operation and in which the toner held by the cleaning brush roller cannot be collected by the toner collecting roller and falls on the member to be cleaned can be prevented. Particularly, at the start of application of the bias voltage, the voltage output from the power output member of the power source for the cleaning brush roller is low, and therefore the problem in that the toner held by the cleaning brush roller falls on the member to be cleaned (i.e., image carriers such as photoreceptor drums and intermediate transfer belts) is caused unless the toner on the cleaning brush roller is certainly removed therefrom. This is because a sufficient cleaning electric field is not formed until the cleaning brush bias rises.

In this regard, the time difference between the bias-on times of the toner collecting bias VC and the cleaning brush bias VB (i.e., the times at which instructions for producing output of VC and VB are provided) is preferably not longer than the time VBn_step. When the time difference is longer than the time VBn_step, one of the biases stays two steps ahead of the other bias, and therefore the difference between the potential of the cleaning brush roller and the potential of the toner collecting roller seriously increases. However, needless to say, it is possible to widen the time difference depending on the value of ΔVBn.

In Example 1, a case in which the bias-on timings differentiate more than a little from each other due to the individual difference of the power source although it is intended to apply the biases at the same time has been described. In this regard, the difference is the time period of from a time at which an output instruction is issued to the power source to a time at which the bias is output from the power output member, and therefore the time difference is much shorter than the bias-rising time. Therefore, in a case in which VCn_step is set to the rising time or the like, even when the bias-on timing is delayed by a time not longer than VCn_step, it is possible to make the setting without causing a problem caused by the delay in the bias-on timing. It is most preferable to make the setting according to the ability of the power source, but the effect of this disclosure can be produced even when the time difference is simply set to a time not greater than VCn_step. Even when the delay in activation is greater than the bias-on timing difference, the time period in which the difference between potentials of the cleaning brush roller and the toner collecting roller is opposite to the targeted value is shorter in Example 2 than in Example 1, and therefore the effect of this disclosure can be produced more than a little.

Example 3

Yet another example (hereinafter referred to as Example 3) of the cleaner of this disclosure will be described.

Examples 1 and 2 are examples concerning control of one pair of a cleaning brush roller and a toner collecting roller (i.e., one cleaning unit). Example 3 is an example concerning control of a cleaner having plural pairs of rollers. In this example, three pairs of rollers are used, and the three cleaning units are hereinafter referred to as first to third cleaning units.

The first cleaning unit includes the first cleaning brush roller 101 and the first toner collecting roller 102. The second cleaning unit includes the second cleaning brush roller 104 and the second toner collecting roller 105. The third cleaning unit includes the third cleaning brush roller 107 and the third toner collecting roller 108.

In Example 3, the cleaner includes three cleaning units, i.e., the first to third cleaning units. However, similar description can be made for a cleaner having plural cleaning units (each including a pair of a cleaning brush roller and a toner collecting roller).

These first, second and third cleaning brush rollers 101, 104 and 107 are electrically connected with each other with a member to be cleaned therebetween. The resistance of the member to be cleaned is often controlled so as not to cause current interference. However, since the cleaning brush rollers are typically arranged so as to be close to each other for the viewpoint of layout optimization, it is hard to perfectly avoid the current interference. Particularly, when cleaning brush rollers with opposite polarities are arranged so as to be adjacent to each other, the current interference prominently occurs. Therefore, in a case in which the first and third cleaning units have a positive polarity and the second cleaning unit has a negative polarity, when bias-on is performed only for the first cleaning unit, a current flows into the second cleaning brush roller of the second cleaning unit along the surface of the intermediate transfer belt as can be understood from the equivalent circuit illustrated in FIG. 6. In this case, as described in Example 1, a current often flows into the power source for the second cleaning brush roller, and even into the power source of the second toner collecting roller. Similarly to the above-description, when the inflowing current is large, the power sources are defectively activated.

Figure 12:
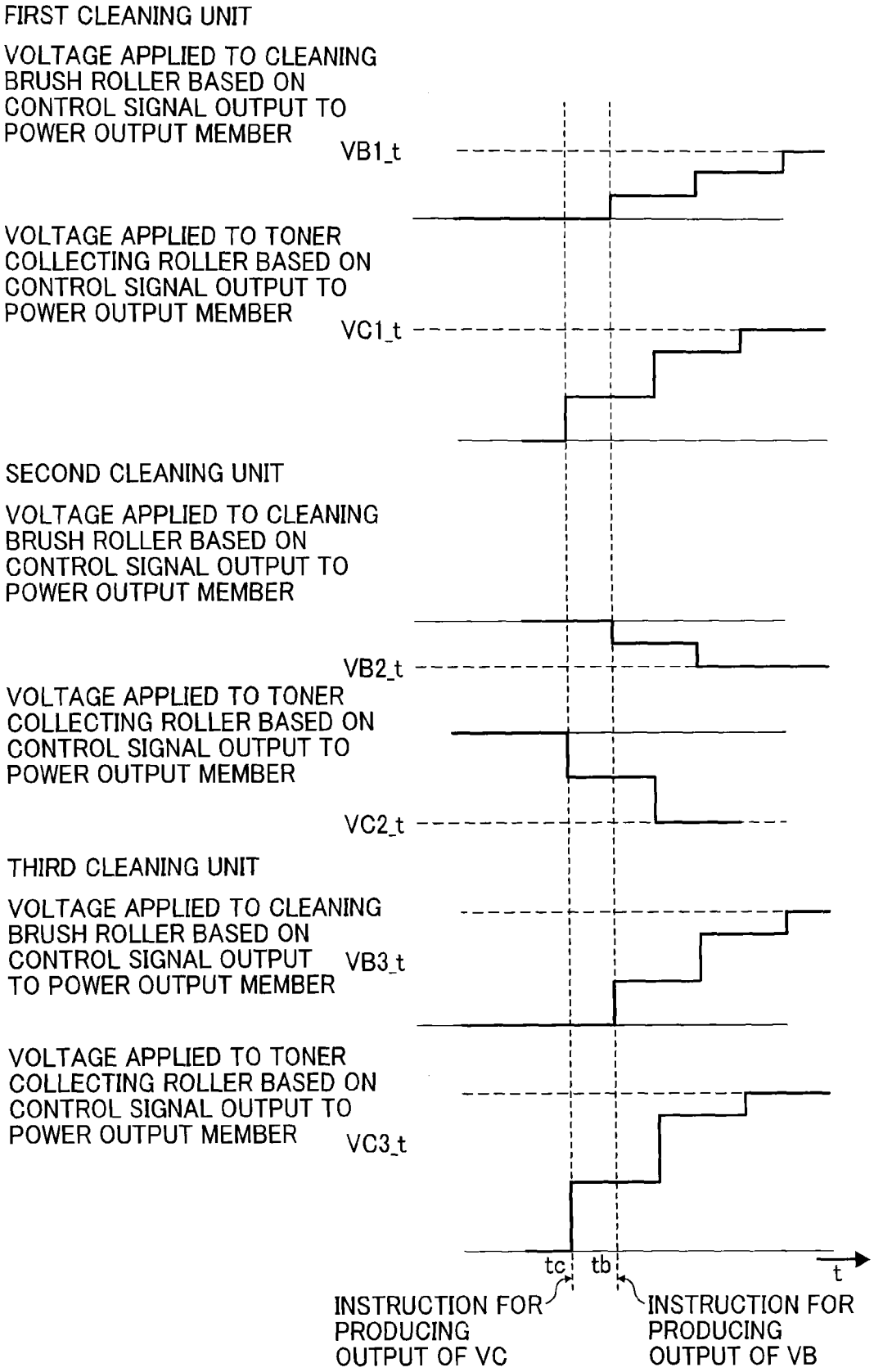
FIG. 12 is a waveform chart for describing an example of the control sequence for all the cleaning units in the bias-rising time.

Therefore, in Example 3, the bias-on timing is the same for all the cleaning units. FIG. 12 is a waveform chart for describing the control sequence for all the cleaning units at the bias-rising time in Example 3. As illustrated in FIG. 12, each of the first to third cleaning brush rollers and the first to third toner collecting rollers has the targeted final applied voltage (VBn_t and VCn_t). Each of the control signals, which correspond to the applied voltages and are output from the corresponding power control members, is changed (increased or decreased) in a step-by-step manner so as to reach the targeted final value of the control signal similarly to Example 1. In addition, similarly to Example 2, the bias for the toner collecting roller is turned on at a time $t_c$, which is prior to a time $t_0$ at which the bias for the cleaning brush roller is turned on (i.e., $t_c<t_b$). In this regard, the variation of the bias in one step and the time period of one step may be the same as those in Examples 1 and 2, and therefore control of each cleaning unit is the same as that in Examples 1 and 2, wherein controls of all the cleaning units are synchronized. Although the cleaning units are electrically connected with each other with the member to be cleaned therebetween, the electric interference between the n-th cleaning unit and the (n+1)th cleaning unit is less than that between the cleaning brush roller and the toner collecting roller in the n-th (or (n+1)th) cleaning unit because the intermediate transfer belt 8 (illustrated in the equivalent circuit in FIG. 6) has relatively high resistance. Therefore, occurrence of the defective activation problem in that when all the cleaning units are turned on at the same time, the power sources are defectively activated due to the inflowing current can be prevented.

Figure 13:
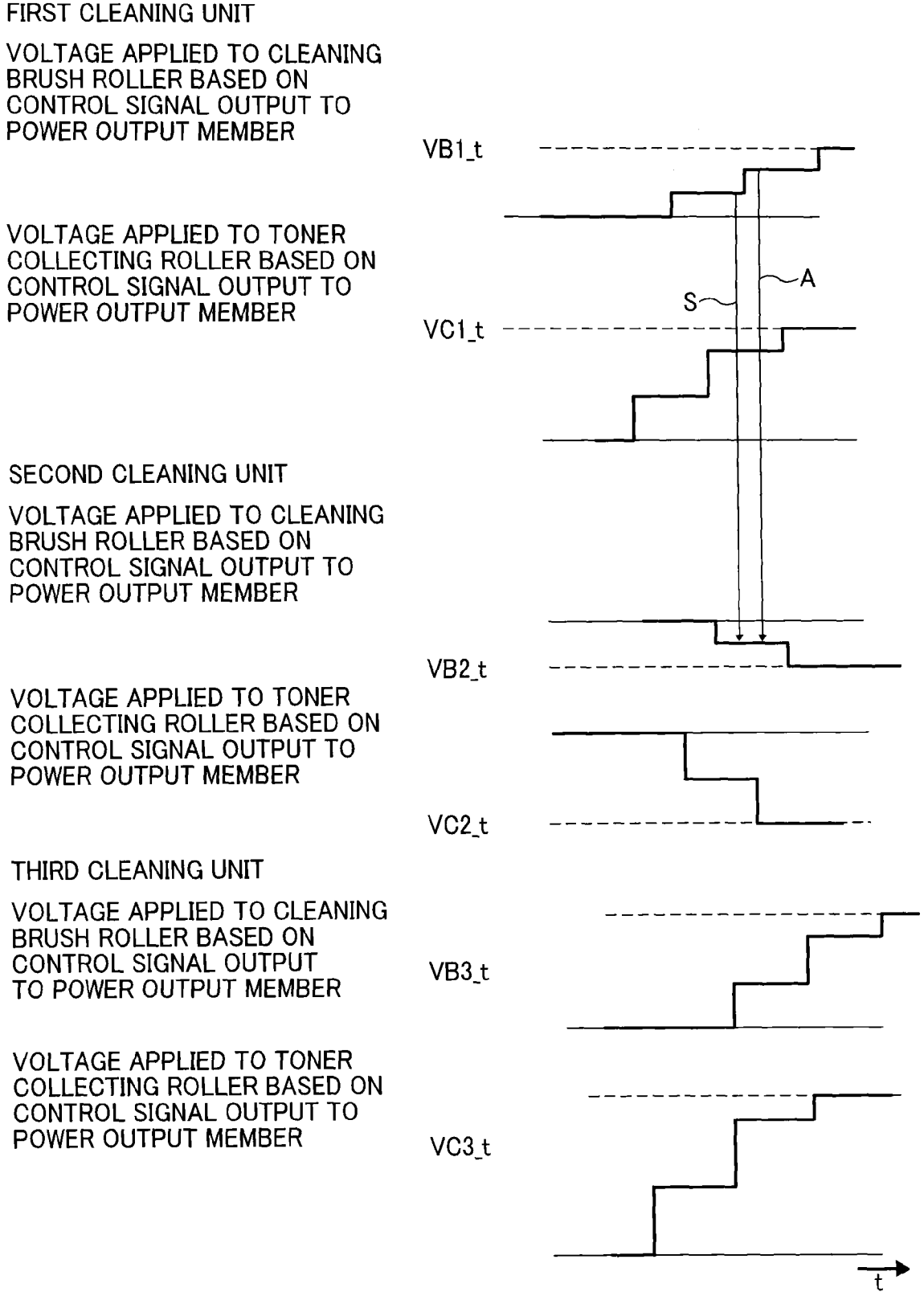
FIG. 13 is a waveform chart for describing the meaning of a simultaneous bias-rising operation.

For example, if the cleaning units are sequentially started up starting from the first cleaning unit in such a manner that after the applied voltage of the n-th cleaning unit reaches the targeted final value, the (n+1)th cleaning unit is started up, a large inflowing current flows depending on the value of VBn_t, thereby making it possible to cause the defective activation problem. In addition, when all the cleaning units are turned on at the same time unlike the step-by-step start-up as described in Examples 1 and 2, a current flows from a firstly activated power source into the other power sources of the cleaning unit and power sources of the other cleaning units, thereby making it possible to cause the defective activation problem. Since the step-by-step start-up is performed in Example 3 similarly to Examples 1 and 2, the inflowing current can be controlled so as to be small even when all the power sources are activated at the same time, resulting in prevention of occurrence of the defective activation problem. In this regard, the "same time" means that at least two adjacent cleaning units are on the same step (same n-th step) as described in the waveform chart illustrated in FIG. 13. Similarly to the above description concerning the potential difference between cleaning units, the difference between the potential of a cleaning brush roller of a cleaning unit and another cleaning brush roller of the adjacent cleaning unit is the following.

At a time S (illustrated in FIG. 13) in which the biases for the cleaning brush rollers are on the same step (i.e., the m-th step): (ΔVB1−ΔVB2)×m At a time A (illustrated in FIG. 13) in which the biases for the cleaning brush rollers are on different steps: ΔVB1×m−ΔVB2×(m−1)

At a time B (not illustrated in FIG. 13) in which the biases for the cleaning brush rollers are on different steps: ΔVB1×(m−1)−ΔVB2×m In addition, a relationship, ΔVBn<VBn_t/m, is satisfied.

Therefore, at a time in one step, the following relationship is satisfied:

$$(\Delta VB1-\Delta VB2)\times m\leq(VB1_t/m-VB2_t/m)\times m=VB1_t-VB2_t.$$

At the times A and B, the same description can be made, and therefore only the description of the time A will be made. Specifically, at the time A, the following relationship is satisfied:

$$\Delta VB1\times m-\Delta VB2\times(m-1)=(\Delta VB1-\Delta VB2)\times m+\Delta VB2\leq(VB1_t-VB2_t)+AVB2.$$

Therefore, the potential difference is always not greater than VB1_t−VB2_t+ΔVB2. Since each of VB1_t and VB2_t is the targeted bias by which good cleaning can be performed, the interference problem is not caused. In addition, since the potential difference is greater by ΔVB2, by which a sufficiently small amount of inflowing current flows between the cleaning brush roller and the toner collecting roller, the inflowing current flowing along the intermediate transfer belt is sufficiently small, thereby making it possible to prevent occurrence of the defective activation problem.

Example 4

Still another example (hereinafter referred to as Example 4) of the cleaner of this disclosure will be described.

Figure 14:
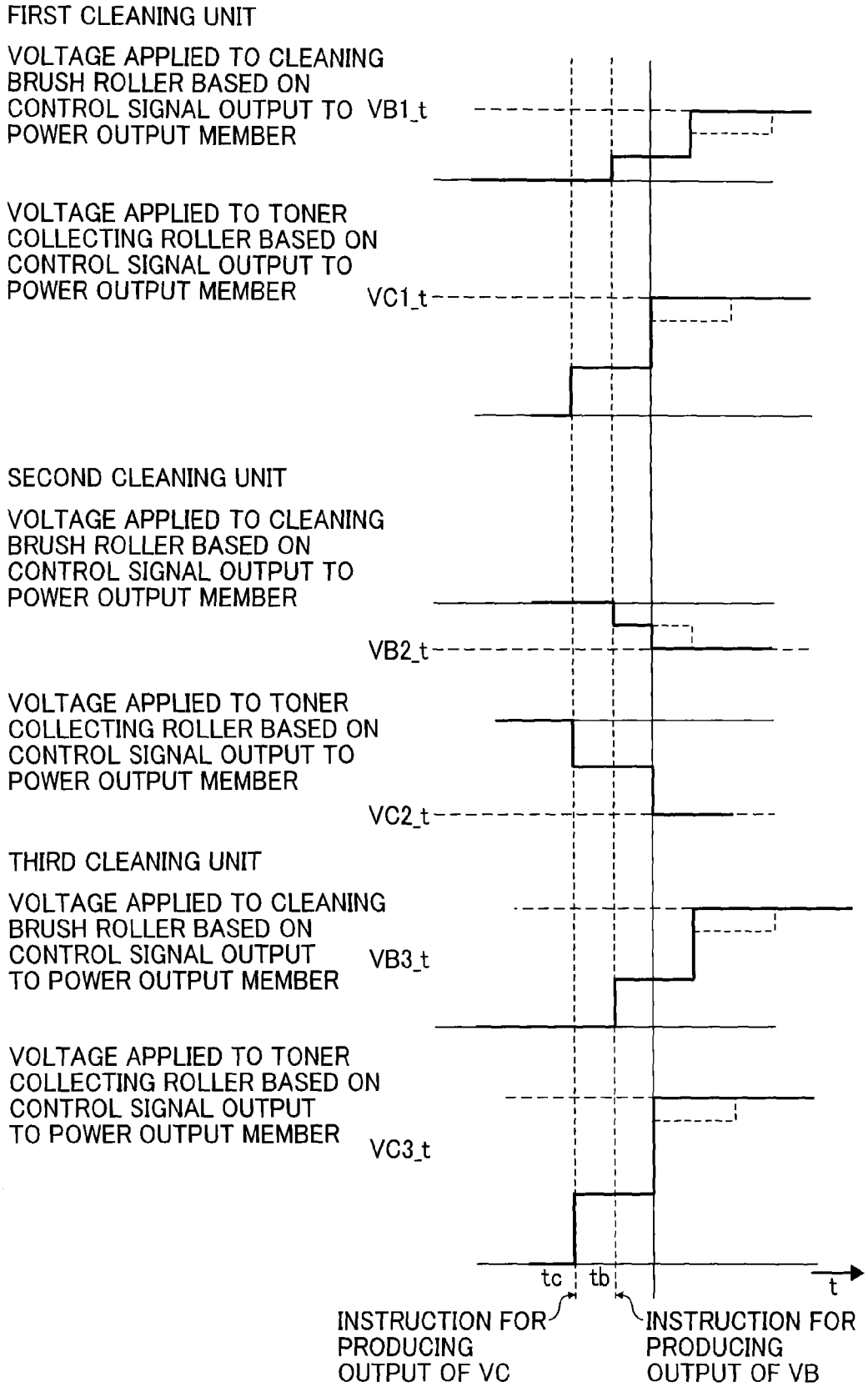
FIG. 14 is a waveform chart for describing another example of the control sequence for all the cleaning units in the bias-rising time.

In Example 4, control of shortening of the rising time is performed based on Example 3. FIG. 14 is a waveform chart for describing the control sequence for all the cleaning units at the bias-rising time in Example 4. The waveform of the bias illustrated in FIG. 14 is substantially the same as those illustrated in FIGS. 12 and 13 except for the following. Specifically, as illustrated in FIG. 12, the targeted final voltage of the second cleaning unit is relatively low compared to those of the other cleaning units, and therefore the bias reaches the targeted final voltage at the second step while the biases of the other cleaning units reach the targeted final voltages at the third step. Therefore, in Example 4, when there is a cleaning unit in which one of the biases thereof reaches the targeted final voltage, the residual steps for the other bias of the cleaning unit and the other cleaning units are omitted, and the other bias of the cleaning unit and the biases of the other cleaning units are raised at once at the second step so as to reach the targeted final voltages as illustrated in FIG. 14. Specifically, as illustrated in FIG. 14, among the biases of the first to third cleaning units, the toner collecting bias of the second cleaning unit initially reaches the targeted final voltage. In this case, as illustrated in FIG. 14, the voltage of the control signal (which is output from the power control member to the power output member) for the cleaning brush roller of the second cleaning unit, and the voltages of the control signals for the cleaning brush rollers and the toner collecting rollers of the first and third cleaning units are raised at the second step so as to reach the targeted final voltages. This is because at a time in which the bias of any one of the cleaning units reaches the targeted final voltage, the difference between the potential of the cleaning brush roller of the cleaning unit and the potentials of the cleaning brush rollers of the other cleaning units is not greater than VBn_t and VBn±1_t. Namely, in this case, the cleaning brush roller of the cleaning unit whose voltage already reaches the targeted voltage maintains the voltage VBn_t, and the voltages of the other cleaning units are gradually raised and reach the VB n±1_t at the end.

By using this method, the start-up operation can be performed quickly. This method in which after the bias of any one of the cleaning units reaches the targeted final voltage, the bias-rising operation is performed on each of the cleaning units while omitting the residual voltage increasing steps is hereinafter referred to as a time shortening mode. For example, when the power sources are started up once (i.e., at least the first step is ended) in Example 3, the interference between the cleaning brush roller and the toner collecting roller does not cause a problem even if the residual two steps are performed at once, and therefore by performing the residual two steps at once, a time shortening operation can be performed. In addition, in a case in which performing three or more steps at once causes no problem, three or more steps can be performed at once. In contrast, if performing two steps at once causes the interference problem between the cleaning brush roller and the toner collecting roller, such a control operation as mentioned above in Example 4 cannot be performed.

The time shortening is not limited to omission of steps, and it is possible to shorten the time period of each step.

In Example 4, this time shortening mode is used for a cleaning operation after the image forming apparatus causes a jamming problem in that a recording medium is jammed in the image forming apparatus and that can be detected by the sensor 160 and the controller 170 illustrated in FIG. 1. In general, the cleaner of an image forming apparatus is started up in synchronization with start-up of the image forming apparatus, and therefore the voltage can be gradually raised in the cleaner, namely, time shortening is not necessary in this case. In contrast, when the jamming problem is caused, a non-transferred toner image is present on the intermediate transfer belt, and therefore it is necessary to quickly perform cleaning by quickly applying the cleaning bias to the cleaner. Therefore, in Example 4, the time shortening mode is used only for the cleaning operation after the image forming apparatus causes the jamming problem. In this regard, if formation of the first copy delays in an image forming apparatus due to long rising time of the cleaning bias of the cleaner of the image forming apparatus, it is effective to regularly use the time shortening mode therefor.

Next, toner suitable for this printer will be described.

The toner suitable for this printer typically reproduces fine dot toner images with a size of 600 dpi (dot per inch) or smaller, and therefore the toner preferably has a volume average particle diameter of from 3 μm to 6 μm. In addition, the Dv/Dn ratio of the volume average particle diameter (Dv) to the number average particle diameter (Dn) of the toner is preferably from 1.00 to 1.40. In this regard, as the Dv/Dn ratio approaches 1.00, the toner has a sharper particle diameter distribution. Such a toner as having a small particle diameter and a sharp particle diameter distribution has a sharp charge quantity distribution, and therefore high quality toner images without background development can be produced. In addition, when an electrostatic transferring method in which a toner image is transferred by an electrostatic force is used for image formation, the transfer rate can be enhanced.

Figure 15:
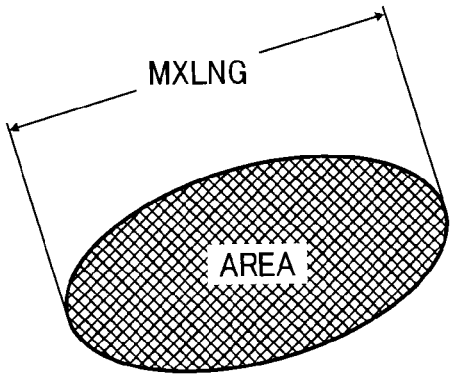
FIG. 15 is a schematic view for describing the maximum diameter and the area of the projected image of a toner particle.

The toner preferably has a first shape factor SF-1 of from 100 to 180, and a second shape factor SF-2 of from 100 to 180. FIG. 15 is a schematic view for describing the first shape factor SF-1. The first shape factor SF-1 represents the degree of the roundness of a toner particle, and is defined by the following equation:

$$SF\text{-}1=\{(\mathrm{MXLNG})^2/(\mathrm{AREA})\}\times(100\pi/4),$$

wherein MXLNG represents the maximum diameter of the projected image of a toner particle formed on a two-dimensional plane, and AREA represents the area of the projected image.

When the first shape factor SF-1 is 100, the toner particle is spherical. As the shape factor SF-1 increases, the shape of the toner particle becomes more irregular.

Figure 16:
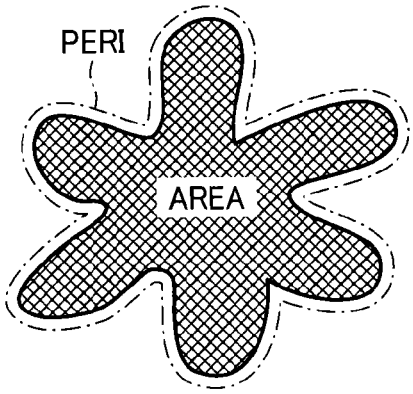
FIG. 16 is a schematic view for describing the peripheral length and the area of the projected image of a toner particle.

FIG. 16 is a schematic view for describing the second shape factor SF-2. The second shape factor SF-2 represents the degree of the concavity and convexity of a toner particle, and is defined by the following equation:

$$SF\text{-}2=\{(\mathrm{PERI})^2/(\mathrm{AREA})\}\times(100/4\pi),$$

wherein PERI represents the peripheral length of the projected image of a toner particle formed on a two-dimensional plane, and AREA represents the area of the projected image.

When the second shape factor SF-2 is 100, the toner particle has a smooth surface (i.e., the toner has no concavity and convexity). As the SF-2 increases, the toner particle has a rougher surface.

The first and second shape factors SF-1 and SF-2 can be determined by the following method:

(1) Particles of a toner are photographed using a scanning electron microscope (S-800, manufactured by Hitachi Ltd.); and (2) Photograph images of one hundred toner particles are analyzed using an image analyzer (LUZEX 3 manufactured by Nireco Corp.) to determine the first and second shape factors SF-1 and SF-2 of the toner.

When the shape of a toner approaches the spherical form, toner particles of the toner make a point contact with each other. Therefore, the adsorption force between toner particles weakens, and thereby the fluidity of the toner is enhanced. In addition, adsorption force between toner particles and a photoreceptor weakens, and thereby the transfer rate of the toner is increased. When one of the shape factors SF-1 and SF-2 exceeds 180, the transfer rate of the toner deteriorates, and therefore it is not preferable.

Toners used for color printers are preferably prepared by a method including preparing a toner component liquid by dissolving or dispersing at least a polyester prepolymer having a nitrogen-containing functional group, a polyester, a colorant and a release agent in an organic solvent; and subjecting the toner component liquid to at least one of a crosslinking reaction and a polymer chain growth reaction in an aqueous medium to form toner particles.

Hereinafter the toner constituents of the toner, and the preparation method thereof will be described.

(Polyester)

Polyester can be prepared by subjecting a polyalcohol (PO) and a polycarboxylic acid (PC) to a polycondensation reaction.

Dihydric alcohols (DIO), and tri- or more-hydric alcohols (TO) can be used as the polyalcohol (PO). Among these polyalcohols, dihydric alcohols, or combinations of a dihydric alcohol and a small amount of a tri- or more-hydric alcohol can be preferably used.

Specific examples of such dihydric alcohols (DIO) include alkylene glycols such as ethylene glycol, 1,2-propylene glycol, 1,3-propylene glycol, 1,4-butane diol, and 1,6-hexane diol; alkylene ether glycols such as diethylene glycol, triethylene glycol, dipropylene glycol, polyethylene glycol, polypropylene glycol, and polytetramethylene ether glycol; alicyclic diols such as 1,4-cyclohexane dimethanol, and hydrogenated bisphenol A; bisphenol compounds such as bisphenol A, bisphenol F, and bisphenol S; alkylene oxide (such as ethylene oxide, propylene oxide, and butylene oxide) adducts of the alicyclic diols mentioned above; and alkylene oxide (such as ethylene oxide, propylene oxide, and butylene oxide) adducts of the bisphenol compounds mentioned above.

Among these dihydric alcohols, alkylene glycols having 2 to 12 carbon atoms, and alkylene oxide adducts of bisphenol compounds are preferable, and alkylene oxide adducts of bisphenol compounds, and combinations of an alkylene oxide adduct of a bisphenol compound and an alkylene glycol having 2 to 12 carbon atoms are more preferable.

Specific examples of the tri- or more-hydric alcohols (TO) include aliphatic alcohols having three or more hydroxyl groups such as glycerin, trimethylol ethane, trimethylol propane, pentaerythritol, and sorbitol; polyphenols having three or more hydroxyl groups such as trisphenol PA, phenol novolac, and cresol novolac; and alkylene oxide (such as ethylene oxide, propylene oxide, and butylene oxide) adducts of the polyphenols mentioned above.

Dicarboxylic acids (DIC) and polycarboxylic acids (TC) having three or more carboxyl groups are used as the polycarboxylic acid (PC). Among these polycarboxylic acids, dicarboxylic acids, or combinations of a dicarboxylic acid and a small amount of a polycarboxylic having three or more carboxyl groups acid are preferable.

Specific examples of the dicarboxylic acids (DIC) include alkylene dicarboxylic acids such as succinic acid, adipic acid, and sebacic acid; alkenylene dicarboxylic acids such as maleic acid, and fumaric acid; and aromatic dicarboxylic acids such as phthalic acid, isophthalic acid, terephthalic acid, and naphthalene dicarboxylic acids. Among these dicarboxylic acids, alkenylene dicarboxylic acids having from 4 to 20 carbon atoms, and aromatic dicarboxylic acids having from 8 to 20 carbon atoms are preferably used.

Specific examples of the polycarboxylic acids (TC) having three or more carboxyl groups include aromatic polycarboxylic acids having from 9 to 20 carbon atoms such as trimellitic acid, and pyromellitic acid.

Anhydrides and lower alkyl esters (such as methyl esters, ethyl esters and isopropyl esters) of the above-mentioned polycarboxylic acids can also be used for the polycarboxylic acid (PC).

Suitable mixing ratio of a polyalcohol (PO) to a polycarboxylic acid (PC) (i.e., an equivalence ratio [OH]/[COOH]) of the hydroxyl group of the polyalcohol to the carboxyl group of the polycarboxylic acid) is from 2/1 to 1/1, preferably from 1.5/1 to 1/1, and more preferably from 1.3/1 to 1.02/1.

The polycondensation reaction of a polyalcohol (PO) with a polycarboxylic acid (PC) is performed, for example, by a method in which the components are heated to a temperature of from 150 to 280° C. in the presence of a known esterification catalyst such as tetrabutoxy titanate and dibutyltin oxide while optionally distilling away generated water under a reduced pressure to prepare a polyester resin having a hydroxyl group.

The polyester preferably has a hydroxyl value of not less than 5 mgKOH/g, and an acid value of from 1 to 30 mgKOH/g, and preferably from 5 to 20 mgKOH/g.

When a polyester having an acid value is used, the resultant toner can have a negative charging property. In addition, the toner has good affinity for recording papers, resulting in enhancement of the low temperature fixability of the toner.

However, when the acid value is greater than 30 mgKOH/g, stability of the charging property of the toner deteriorates particularly when the environmental conditions change.

The weight average molecular weight of the polyester is from 10,000 to 400,000, and preferably from 20,000 to 200,000. When the weight average molecular weight is less than 10,000, the offset resistance of the toner tends to deteriorate. In contrast, when the weight average molecular weight is greater than 400,000, the low temperature fixability of the toner tends to deteriorate, and therefore it is not preferable.

Urea-modified polyesters can also be preferably used as the polyester as well as the above-mentioned unmodified polyesters prepared by a polycondensation reaction. Urea-modified polyesters can be prepared by reacting a polyisocyanate compound (PIC) with a carboxyl group or a hydroxyl group present at the end of the above-mentioned unmodified polyester to prepare a polyester prepolymer (A) having an isocyanate group, and then reacting an amine compound with the prepolymer (A) to perform a crosslinking reaction and/or a polymer chain growth reaction.

Specific examples of the polyisocyanate compounds (PIC) include, but are not limited thereto, aliphatic polyisocyanates (such as tetramethylene diisocyanate, hexamethylene diisocyanate, and 2,6-diisocyanato methylcaproate); alicyclic polyisocyanates (such as isophorone diisocyanate, and cyclohexylmethane diisocyanate); aromatic diisocyanates (such as tolylene diisocyanate, and diphenylmethane diisocyanate); aromatic aliphatic diisocyanates (such as a, a, a', a'-tetramethyl xylylene diisocyanate); isocyanurates; and blocked isocyanates such as polyisocyanates blocked with a phenol derivative, an oxime, or a caprolactam. These compounds can be used alone or in combination.

When synthesizing a polyester prepolymer (A) having an isocyanate group, the suitable mixing ratio of a polyisocyanate to a polyester having a hydroxyl group (i.e., an equivalence ratio [NCO]/[OH] of the isocyanate group of a polyisocyanate (PIC) to the hydroxyl group of a polyester) is from 5/1 to 1/1, preferably from 4/1 to 1.2/1, and more preferably from 2.5/1 to 1.5/1. When the ratio [NCO]/[OH] is greater than 5/1, the low temperature fixability of the toner tends to deteriorate. In contrast, when the ratio [NCO]/[OH] is less than 1/1, the urea content of the urea-modified polyester decreases, resulting in deterioration of the hot offset resistance of the toner. The content of the unit obtained from the polyisocyanate in the polyester prepolymer (A) having a polyisocyanate group is from 0.5 to 40% by weight, preferably from 1 to 30% by weight, and more preferably from 2 to 20% by weight.

When the content is less than 0.5% by weight, the hot offset resistance of the toner tends to deteriorate, and in addition it is hard to impart a good combination of high temperature fixability and low temperature fixability to the toner. In contrast, when the content is greater than 40% by weight, the low temperature fixability of the toner tends to deteriorate.

The number of the isocyanate group in a polyester prepolymer (A) is generally not less than 1, preferably from 1.5 to 3 in average, and more preferably from 1.8 to 2.5 in average. When the number is less than 1, the molecular weight of the urea-modified polyester decreases, resulting in deterioration of the hot offset resistance of the toner.

By reacting an amine with the polyester prepolymer (A), a urea-modified polyester resin can be prepared. Specific examples of such an amine include diamines (B1), polyamines (B2) having three or more amino groups, amino alcohols (B3), amino mercaptans (B4), amino acids (B5), and blocked amines in which amino groups of the above-mentioned amine compounds B1-B5 are blocked.

Specific examples of the diamines (B1) include aromatic diamines (such as phenylene diamine, diethyltoluene diamine, and 4,4'-diaminodiphenyl methane); alicyclic diamines (such as 4,4'-diamino-3,3'-dimethyldicyclohexyl methane, diaminocyclohexane, and isophorone diamine); and aliphatic diamines (such as ethylene diamine, tetramethylene diamine, and hexamethylene diamine).

Specific examples of the polyamines (B2) having three or more amino groups include diethylene triamine, and triethylene tetramine. Specific examples of the amino alcohols (B3) include ethanol amine, and hydroxyethyl aniline. Specific examples of the amino mercaptans (B4) include aminoethyl mercaptan, and aminopropyl mercaptan. Specific examples of the amino acids (B5) include amino propionic acid, and amino caproic acid. Specific examples of the blocked amines (B6) include ketimine compounds obtained from the amines B1-B5 and ketones such as acetone, methyl ethyl ketone and methyl isobutyl ketone, and oxazolidine compounds.

Among these amine compounds (B), diamines (B1) and combinations of a diamine (B1) and a small amount of polyamine (B2) are preferable.

The mixing ratio of a polyester prepolymer (A) having an isocyanate group to an amine compound (B) (i.e., an equivalence ratio [NCO]/[NHx] of the isocyanate group of a polyester prepolymer (A) to the amino group of an amine (B)) is from 1/2 to 2/1, preferably from 1/1.5 to 1.5/1, and more preferably from 1/1.2 to 1.2/1. When the ratio is greater than 2/1 or less than 1/2, the molecular weight of the urea-modified polyester decreases, resulting in deterioration of the hot offset resistance of the toner.

The urea-modified polyester can include a urethane bond as well as a urea bond. The molar ratio of the urea bond to the urethane bond is from 100/0 to 10/90, preferably from 80/20 to 20/80, and more preferably from 60/40 to 30/70. When the molar ratio of the urea bond is less than 10%, the hot offset resistance of the toner tends to deteriorate.

Urea-modified polyester can be prepared by a one shot method or the like.

Specifically, in the method, a polyalcohol (PO) and a polycarboxylic acid (PC) are heated to a temperature of form 150 to 280° C. in the presence of an esterificaiton catalyst such as tetrabutoxy titanate and dibutyltin oxide while optionally distilling away generated water at a reduced pressure to prepare a polyester resin having a hydroxyl group. Next, the polyester is reacted with a polyisocyanate (PIC) at a temperature of from 40 to 140° C. to prepare a polyester prepolymer (A) having an isocyanate group. Further, the polyester prepolymer (A) is reacted with an amine compound (B) at a temperature of from 0 to 140° C. to prepare a urea-modified polyester.

When a polyisocyanate compound (PIC) is reacted or when a polyester prepolymer (A) is reacted with an amine compound (B), a solvent can be used if desired. Specific examples of the solvent include solvents inactive with a polyisocyanate compound (PIC) such as aromatic solvents (e.g., toluene and xylene); ketones (e.g., acetone, methyl ethyl ketone, and methyl isobutyl ketone); esters (e.g., ethyl acetate); amides (e.g., dimethylformamide, and dimethylacetamide); and ethers (e.g., tetrahydrofuran).

When a polyester prepolymer (A) and an amine (B) are subjected to a crosslinking reaction and/or a polymer chain growth reaction, a reaction terminator can be used for at least one of the reactions, if desired, to control the molecular weight of the urea-modified polyester. Specific examples of such a reaction terminator include monoamines such as diethylamine, dibutylamine, butylamine, laurylamine, and blocked monoamines such as ketimine compounds in which the above-mentioned monoamines are blocked with a ketone compound.

The weight average molecular weight of the urea-modified polyester is not less than 10,000, preferably from 20,000 to 10,000,000, and more preferably from 30,000 to 1,000,000. When the weight average molecular weight is less than 10,000, the hot offset resistance of the toner deteriorates.

The number average molecular weight of the urea-modified polyester resin is not particularly limited if the above-mentioned unmodified polyester is used in combination, and importance is attached to the weight average molecular weight. When a urea-modified polyester is used alone, the number average molecular weight thereof is from 2,000 to 20,000, preferably from 2,000 to 10,000, and more preferably from 2,000 to 8,000. When the number average molecular weight is greater than 20,000, the low temperature fixability of the toner tends to deteriorate, and glossiness of toner images tends to deteriorate when the toner is used for full color image forming apparatuses.

Using a combination of an unmodified polyester and a urea-modified polyester is more preferable than in a case in which only a urea-modified polyester is used, because the low temperature fixability of the toner can be enhanced, and in addition the glossiness of toner images can be enhanced when the toner is used for full color image forming apparatuses. In this regard, the unmodified polyester resin can include a chemical bond other than a urea bond.

When a combination of an unmodified polyester and a urea-modified polyester is used, the polyesters are preferably compatible with each other at least partially to impart a good combination of low temperature fixability and hot offset resistance to the toner. Therefore, it is preferable that the unmodified polyester and the urea-modified polyester used in combination are similar in composition.

The weight ratio of an unmodified polyester to a urea-modified polyester is from 20/80 to 95/5, preferably from 70/30 to 95/5, more preferably from 75/25 to 95/5, and even more preferably from 80/20 to 93/7. When the content of a urea-modified polyester is less than 5% by weight, the hot offset resistance of the toner tends to deteriorate, and it is hard to impart a good combination of high temperature preservability and low temperature fixability to the toner.

The binder resin of the toner, which includes an unmodified polyester and a urea-modified polyester, preferably has a glass transition temperature (Tg) of from 45 to 65° C., and preferably from 45 to 60° C. When the Tg is lower than 45° C., the heat resistance of the toner tends to deteriorate. When the Tg is higher than 65° C., the low temperature fixability of the toner tends to deteriorate.

Since a urea-modified polyester tends to be present in a surface portion of toner particles, the high temperature preservability of the toner is better than in a case in which a general polyester is used as the binder resin of the toner even when the glass transition temperature of the urea-modified polyester is relatively low.

(Colorant)

Suitable materials for use as the colorant of the toner include known dyes and pigments. Specific examples of such dyes and pigments include carbon black, Nigrosine dyes, black iron oxide, NAPHTHOL YELLOW S, HANSA YELLOW 10G, HANSA YELLOW 5G, HANSA YELLOW G, Cadmium Yellow, yellow iron oxide, loess, chrome yellow, Titan Yellow, polyazo yellow, Oil Yellow, HANSA YELLOW GR, HANSA YELLOW A, HANSA YELLOW RN, HANSA YELLOW R, PIGMENT YELLOW L, BENZIDINE YELLOW G, BENZIDINE YELLOW GR, PERMANENT YELLOW NCG, VULCAN FAST YELLOW 5G, VULCAN FAST YELLOW R, Tartrazine Lake, Quinoline Yellow LAKE, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED F2R, PERMANENT RED F4R, PERMANENT RED FRL, PERMANENT RED FRLL, PERMANENT RED F4RH, Fast Scarlet VD, VULCAN FAST RUBINE B, Brilliant Scarlet G, LITHOL RUBINE GX, Permanent Red FSR, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE RS, INDANTHRENE BLUE BC, Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

The content of such a colorant in the toner is preferably from 1 to 15% by weight, and more preferably from 3 to 10% by weight of the toner.

Master batches, which are complexes of a colorant with a resin (binder resin), can also be used as the colorant of the toner. Specific examples of the resin for use in the master batches include homopolymers of styrene or styrene derivatives such as polystyrene, poly-p-chlorostyrene, and polyvinyl toluene; copolymers of styrene and vinyl compounds; polymethyl methacrylate, polybutyl methacrylate, polyvinyl chloride, polyvinyl acetate, polyethylene, polypropylene, polyester, epoxy resins, epoxy polyol resins, polyurethane, polyamide, polyvinyl butyral, polyacrylic acid resins, rosin, modified rosins, terpene resins, aliphatic or alicyclic hydrocarbon resins, aromatic petroleum resins, chlorinated paraffin, and paraffin waxes. These resins can be used alone or in combination.

(Charge Controlling Agent)

Any known charge controlling agents can be used for the toner. Suitable materials for use as the charge controlling agent include Nigrosine dyes, triphenyl methane dyes, chromium-containing metal complex dyes, molybdic acid chelate pigments, Rhodamine dyes, alkoxyamines, quaternary ammonium salts (including fluorine-modified quaternary ammonium salts), alkylamides, phosphor and its compounds, tungsten and its compounds, fluorine-containing surfactants, metal salts of salicylic acid, metal salts of salicylic acid derivatives, copper phthalocyanine, perylene, quinacridone, azo pigments, and polymers having a functional group such as a sulfonate group, a carboxyl group, and a quaternary ammonium salt group.

Specific examples of marketed charge controlling agents include BONTRON 03 (Nigrosine dye), BONTRON P-51 (quaternary ammonium salt), BONTRON S-34 (metal-containing azo dye), BONTRON E-82 (metal complex of oxynaphthoic acid), BONTRON E-84 (metal complex of salicylic acid), and BONTRON E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE PR (triphenyl methane derivative), COPY CHARGE NEG VP2036 and COPY CHARGE NX VP434 (quaternary ammonium salt), which are manufactured by Hoechst AG; and LRA-901 and LR-147 (boron complex), which are manufactured by Japan Carlit Co., Ltd.

Among these charge controlling agents, materials capable of negatively charging the toner are preferable.

The added amount of such a charge controlling agent is determined depending on choice of binder resin, presence or absence of additives, and the toner preparation method including the dispersing method, and is not unambiguously determined. However, the added amount is preferably from 0.1 to 10 parts by weight, and more preferably from 0.2 to 5 parts by weight, based on 100 parts by weight of the binder resin. When the added amount is greater than 10 parts by weight, the toner tends to have an excessively large charge property, thereby increasing electrostatic attraction between the toner and a developing roller, resulting in deterioration of fluidity of the toner (developer) and decrease of image density.

(Release Agent)

Waxes having a low melting point of from 50 to 120° C. are preferably used because such a wax satisfactorily serves as a release agent when being dispersed in a binder resin, and when a toner image is fixed, the release agent is present between a fixing roller and the toner image, thereby enhancing the hot offset resistance of the toner. Therefore, the toner can be used without applying a release agent such as oils to the fixing roller.

Specific examples of the release agent for use in the toner include, but are not limited thereto, vegetable waxes such as carnauba waxes, cotton waxes, Japan waxes, and rice waxes; animal waxes such as bees waxes, and lanolin; mineral waxes such as ozocerite and ceresin waxes; petroleum waxes such as paraffin waxes, microcrystalline waxes, and petrolatum; synthesized hydrocarbon waxes such as Fischer-Tropsch waxes, and polyethylene waxes; synthesized waxes such as esters, ketones and ethers; amides and imides such as 12-hydroxystearamide, stearamide, and phthalic anhydride imide; chlorinated hydrocarbons; and low molecular weight crystalline polymers having a long alkyl group in a side chain thereof such as homopolymers or copolymers of polyacrylate (e.g., poly(n-stearyl methacrylate), poly(n-lauryl methacrylate), and n-stearyl acrylate—ethyl methacrylate copolymers.

The charge controlling agent and the release agent can be melted and kneaded together with the colorant (master batch) and the binder resin when the toner is prepared by a dry method. Alternatively, the components may be dissolved or dispersed in an organic solvent when the toner is prepared by a wet method.

(External Additive)

In order to enhance the fluidity, the developing property and the charge property of the toner, a particulate inorganic material can be preferably used as an external additive of the toner. Such a particulate inorganic material preferably has an average primary particle diameter of from 5 nm to 2 μm, and more preferably from 5 nm to 500 nm. The BET specific surface area of the particulate inorganic material is preferably from 20 to 500 $m^2/g$. The content of such a particulate inorganic material in the toner is generally from 0.01 to 5% by weight, and preferably from 0.01 to 2.0% by weight.

Specific examples of the particulate inorganic material include, but are not limited thereto, silica, alumina, titanium oxide, barium titanate, magnesium titanate, calcium titanate, strontium titanate, zinc oxide, tin oxide, quartz sand, clay, mica, wollastonite, diatom earth, chromium oxide, cerium oxide, red iron oxide, antimony trioxide, magnesium oxide, zirconium oxide, barium oxide, barium carbonate, calcium carbonate, silicon carbide, and silicon nitride. These materials can be used alone or in combination.

Among these particulate inorganic materials, combinations of a hydrophobized particulate silica and a hydrophobized particulate titanium oxide are preferably used. Particularly, when a particulate material having an average particle diameter of not greater than 500 nm is mixed with toner particles while agitated, the electrostatic force and van der Waals attraction between the inorganic material and the toner particles are dramatically enhanced. Therefore, even when the toner is agitated in a developing device to charge the toner so as to have the desired charge quantity, the inorganic material is not released from the toner particles. Therefore, high quality images can be produced by the toner without forming defective images such as images having omissions therein while the amount of residual toner particles is reduced. Particulate titanium oxides have good environmental stability and impart good image density stability to the toner, but tend to deteriorate the charge rising property of the toner. Therefore, when the added amount of a titanium oxide is greater than that of a silica, the charge rising property of the toner tends to deteriorate.

However, when the added amount of such a combination external additive including a hydrophobized silica and a hydrophobized titanium oxide is in a range of from 0.3 to 1.5% by weight, the charge rising property of the toner hardly deteriorates, and the desired charge rising property can be imparted to the toner. Namely, even when image forming operations are repeatedly performed using the toner, high quality images can be produced stably.

Next, the method for preparing the toner will be described. The following method is a preferable method, but the toner preparation method is not limited thereto.

(Toner Preparation Method)

(1) Initially, a colorant, an unmodified polyester, a polyester prepolymer having an isocyanate group, and a release agent are dispersed in an organic solvent to prepare a toner component liquid.

The organic solvent preferably has a boiling point of not higher than 100° C. so that the solvent can be easily removed after toner particles are prepared. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methyl ethyl ketone, and methyl isobutyl ketone. These organic solvents can be used alone or in combination. Among these organic solvents, aromatic solvents such as toluene, and xylene, and halogenated hydrocarbons such as methylene chloride, 1,2-dichloroethane, chloroform and carbon tetrachloride are preferable. The amount of the organic solvent is from 0 to 300 parts by weight, preferably from 0 to 100 parts by weight, and more preferably from 25 to 70 parts by weight, based on 100 parts by weight of the polyester prepolymer used.

(2) The toner component liquid is emulsified in an aqueous medium in the presence of a surfactant, and a particulate resin.

Water is typically used as the aqueous medium, and the aqueous medium can optionally include an organic solvent such as alcohols (e.g., methanol, isopropyl alcohol, and ethylene glycol), dimethylformamide, tetrahydrofuran, cellosolves (e.g., methyl cellosolve), and lower ketones (e.g., acetone and methyl ethyl ketone).

The amount of the aqueous medium is generally from 50 to 20,000 parts by weight, and preferably from 100 to 1,000 parts by weight, based on 100 parts by weight of the toner component liquid. When the amount of the aqueous medium is less than 50 parts by weight, it is hard to satisfactorily disperse the toner component liquid in the aqueous medium. In contrast, using an aqueous medium in an amount of greater than 20,000 parts by weight is not economical.

In order to satisfactorily disperse the toner component liquid in the aqueous medium, a dispersant such as surfactants and particulate resins can be added in the aqueous medium.

Suitable materials for use as the surfactant include anionic surfactants such as alkylbenzenesulfonic acid salts, α-olefin sulfonic acid salts, and phosphoric acid salts; cationic surfactants such as amine salts (e.g., alkyl amine salts, fatty acid derivatives of amino alcohols, fatty acid derivatives of polyamines, and imidazoline), and quaternary ammonium salts (e.g., alkyltrimethyl ammonium salts, dialkyldimethyl ammonium salts, alkyldimethylbenzyl ammonium salts, pyridinium salts, alkylisoquinolinium salts, and benzethonium chloride); nonionic surfactants such as fatty acid amide derivatives, and polyalcohol derivatives; and ampholytic surfactants such as alanine, dodecylbis(aminoethyl)glycin, bis(octylaminoethyle)glycin, and N-alkyl-N,N-dimethylammonium betaine.

By using a surfactant having a fluoroalkyl group, the effect thereof can be produced even when the added amount of the surfactant is small.

Specific examples of the anionic surfactants having a fluoroalkyl group include fluoroalkyl(C2-10) carboxylic acids and their metal salts, disodium perfluorooctanesulfonylglutamate, sodium 3-{ω-fluoroalkyl(C6-C11)oxy}-1-alkyl(C3-C4) sulfonates, sodium 3-{ω-fluoroalkanoyl(C6-C8)-N-ethylamino}-1-propanesulfonates, fluoroalkyl(C11-C20) carboxylic acids and their metal salts, perfluoroalkyl(C7-C13)carboxylic acids and their metal salts, perfluoroalkyl(C4-C12)sulfonates and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonyl glycin, and monoperfluoroalkyl(C6-C16)ethyl phosphates.

Specific examples of marketed products of such anionic surfactants having a fluoroalkyl group include SARFRONs S-111, S-112 and S-113, which are manufactured by Asahi Glass Co., Ltd.; FLUORADs FC-93, FC-95, FC-98 and FC-129, which are manufactured by Sumitomo 3M Ltd.; UNIDYNEs DS-101 and DS-102, which are manufactured by Daikin Industries, Ltd.; MEGAFACEs F-110, F-120, F-113, F-191, F-812 and F-833 which are manufactured by DIC Corp.; ECTOPs EF-102, 103, 104, 105, 112, 123A, 123B, 306A, 501, 201 and 204, which are manufactured by Tohchem Products Co., Ltd.; FUTARGENTs F-100 and F150, which are manufactured by Neos Co., Ltd.; etc.

Specific examples of the cationic surfactants having a fluoroalkyl group include primary, secondary and tertiary aliphatic amine salts, aliphatic quaternary ammonium salts such as propyltrimethylammonium salts of perfluoroalkyl(C6-C10)sulfoneamide, benzalkonium salts, benzethonium chloride, pyridinium salts, and imidazolinium salts, all of which have a fluoroalkyl group.

Specific examples of marketed products of such cationic surfactants having a fluoroalkyl group include SARFRON S-121 (from Asahi Glass Co., Ltd.); FLUORAD FC-135 (from Sumitomo 3M Ltd.); UNIDYNE DS-202 (from Daikin Industries, Ltd.); MEGAFACEs F-150 and F-824 (from DIC Corp.); ECTOP EF-132 (from Tohchem Products Co., Ltd.); and FUTARGENT F-300 (from Neos Co., Ltd.).

In order to stabilize toner particles, which are formed in the aqueous medium, a particulate resin is included in the aqueous medium. Such a particulate resin is preferably included in an amount such that the surface of the toner particles is covered with the particulate resin at a covering rate of from 10 to 90%. Specific examples of such a particulate resin include particulate polymethyl methacrylate having a particle diameter of 1 μm or 3 μm, particulate polystyrene having a particle diameter of 0.5 μm or 2 μm, and particulate poly(styrene-acrylonitrile) having a particle diameter of 1 μm. Specific examples of marketed products of such particulate resins include PB-200H (from Kao Corp.), SGP and SGP-3G (from Soken Chemical & Engineering Co., Ltd.), and TECHNOPOLYMER SB and MICROPEARL (from Sekisui Chemical Co., Ltd.).

In addition, inorganic dispersants such as tricalcium phosphate, calcium carbonate, titanium oxide, colloidal silica, and hydroxyapatite can also be used.

Polymeric protection colloids can also be used as the dispersant in combination with a particulate resin and/or an inorganic dispersant to stably disperse the toner component liquid in the aqueous medium. Specific examples of such polymeric protection colloids include polymers and copolymers prepared by using monomers such as monomers having a carboxyl group (e.g., acrylic acid, methacrylic acid, α-cyanoacrylic acid, α-cyanomethacrylic acid, itaconic acid, crotonic acid, fumaric acid, maleic acid, and maleic anhydride), acrylic monomers having a hydroxyl group (e.g., α-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alkyl ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), amides and methylol compounds thereof (e.g., acrylamide, methacrylamide, and diacetoneacrylamide acids), monomers having a chlorocarbonyl group (e.g., acrylic acid chloride, and methacrylic acid chloride), and monomers having a nitrogen atom or an alicyclic ring having a nitrogen atom (e.g., vinyl pyridine, vinyl pyrrolidone, vinyl imidazole, and ethylene imine).

In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters); and cellulose compounds such as methyl cellulose, hydroxyethyl cellulose, and hydroxypropyl cellulose, can also be used as the polymeric protective colloid.

Known mixers and dispersing machines such as low speed shearing type dispersing machines, high speed shearing type dispersing machines, friction type dispersing machines, high pressure jet type dispersing machines, and ultrasonic dispersing machine can be used for dispersing the toner component liquid in the aqueous medium. Among these dispersing machines, high speed shearing type dispersing machines are preferably used in order to prepare a dispersion including particles having an average particle diameter of from 2 to 20 μm.

When high shearing type dispersing machines are used, the rotation speed of rotors is not particularly limited, but the rotation speed is generally from 1,000 to 30,000 rpm and preferably from 5,000 to 20,000 rpm. In addition, the dispersing time is also not particularly limited, but is generally from 0.1 to 5 minutes. The temperature in the dispersing process is generally 0 to 150° C. (under pressure), and preferably from 40 to 98° C.

(3) When preparing the emulsion, an amine (B) is added thereto to react the amine with the polyester prepolymer (A) having an isocyanate group. In this reaction, a crosslinking reaction and/or a polymer chain growth reaction is performed. The reaction time is determined depending on the reactivity of the isocyanate group of the prepolymer (A) used with the amine used. However, the reaction time is typically from 10 minutes to 40 hours, and preferably from 2 hours to 24 hours. The reaction temperature is typically from 0 to 150° C. and preferably from 40 to 98° C. In addition, known catalysts such as dibutyltin laurate and dioctyltin laurate can be added, if desired, when the reaction is performed.

(4) After the reaction is completed, the organic solvent is removed from the emulsified dispersion (i.e., reaction product), and the resultant particles are washed and dried to prepare toner particles. In order to remove the organic solvent, the reaction product is gradually heated while agitated to form a laminar flow, and then the reaction product is heated in a certain temperature range while agitated strongly to remove the organic solvent, thereby forming toner particles having a spindle form. In this regard, when a dispersion stabilizer soluble in acids and alkalis such as calcium phosphate is used, the dispersion stabilizer adhered to the toner particles can be removed from the toner particles by dissolving the dispersion stabilizer adhered to the toner particles with an acid such as hydrochloric acid (or an alkali), and then washing the toner particles with water. In addition, such a dispersion stabilizer can be removed by a decomposition method using an enzyme.

(5) Next, a charge controlling agent is attached to the thus prepared toner particles, and a particulate inorganic material such as silica and titanium oxide is added to the toner particles as an external additive, resulting in formation of a toner. Attachment of the charge controlling agent and the particulate inorganic material can be performed by a known method using a mixer or the like.

By using this method, toner having a small average particle diameter and a sharp particle diameter distribution can be easily prepared. In addition, by performing agitation while controlling the agitation strength in the organic solvent removing process, the shape of the toner particles can be freely changed so as to be from a spherical shape to a rugby ball shape. In addition, the surface of the toner particles can also be freely changed so as to be from a smooth surface to a wrinkled surface.

The shape of particles of the toner is a nearly-spherical shape, and is represented by the below-mentioned method.

Figure 17A:
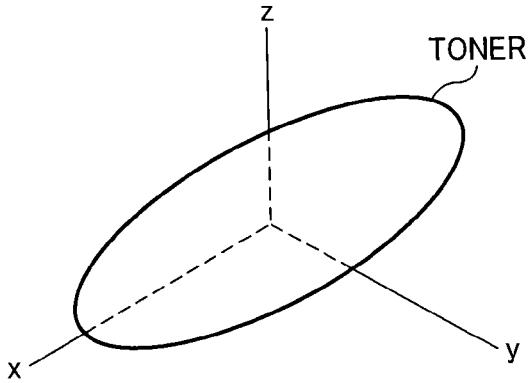
FIGS. 17A-17C are schematic views illustrating a toner particle from different directions.
Figure 17B:
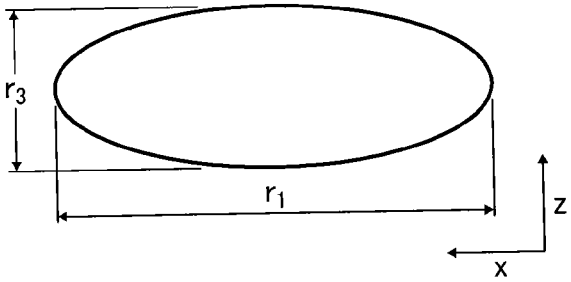
Figure 17C:
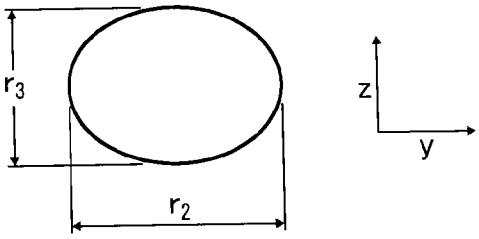

FIGS. 17A-17C are schematic views illustrating a toner particle having a nearly-spherical shape. Referring to FIGS. 17A-17C, the toner particle has a long axis length r1, a short axis length r2 and a thickness r3, wherein r1≥r2≥r3. The toner preferably has a ratio r2/r1 of from 0.5 to 1.0, and a ratio r3/r2 of from 0.7 to 1.0. When the ratio r2/r1 is less than 0.5, the shape is largely different from a spherical shape, and therefore dot reproducibility and transfer efficiency of the toner deteriorate, thereby making it impossible to form high quality images. When the ratio r3/r2 is less than 0.7, the shape becomes a flat shape, and therefore the toner has a low transfer efficiency unlike spherical toner. When the ratio r3/r2 is 1.0, the toner particles can rotate on the long axis, and therefore the toner has excellent fluidity.

The long axis length, short axis length, and thickness r1, r2 and r3 are measured by a method in which a toner particle is observed with a scanning electron microscope (SEM) while changing the viewing angle.

Figure 18:
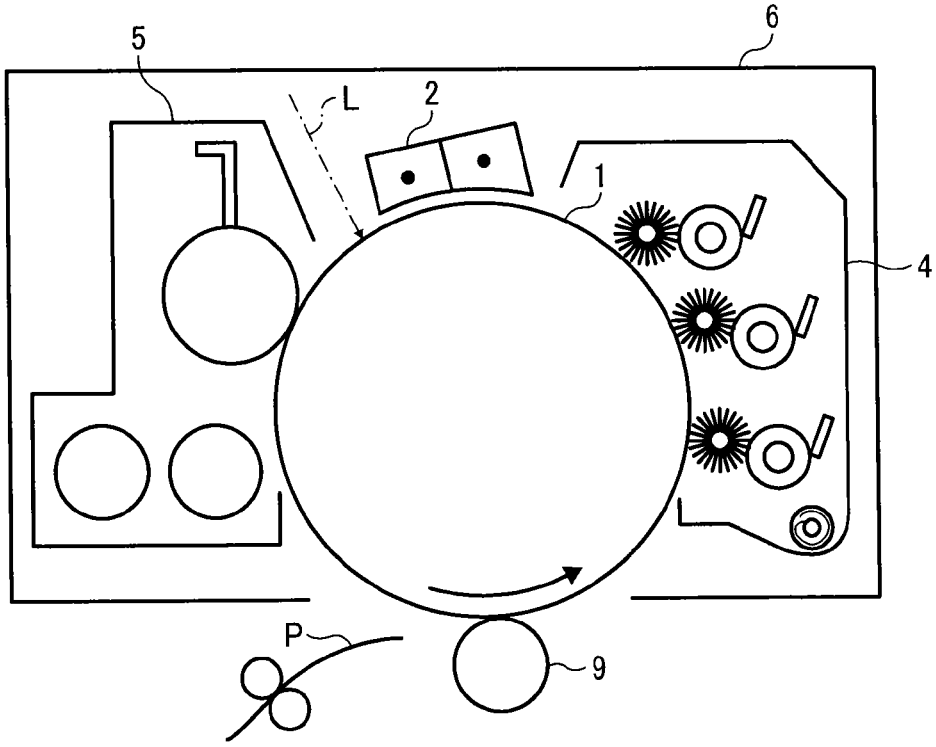
FIG. 18 is a schematic view illustrating the main portion of a monochromatic printer as another example of the image forming apparatus.

The cleaner of this disclosure can also be used as a drum cleaner 4 illustrated in FIG. 18. In an image forming apparatus illustrated in FIG. 18, residual toner on the surface of the photoreceptor 1 (such as residual toner particles, a patterned toner image formed in the above-mentioned refresh mode, and a non-transferred toner image remaining on the surface of the photoreceptor 1 without being transferred onto the recording medium P, for example, in a jamming problem) is fed into the cleaner 4. By using the above-mentioned cleaner of this disclosure for the drum cleaner 4, the toner on the surface of the photoreceptor 1 can be satisfactorily removed therefrom. In FIG. 18, numeral 6 denotes the image forming unit, and numerals 2, 5 and 9 denote the charger, the developing device, and the primary transfer roller, respectively. Character L denotes a light beam emitted by an irradiator to form an electrostatic latent image on the photoreceptor 1.

Second Embodiment

Hereinafter, a second embodiment of the image forming apparatus of this disclosure, which includes the cleaner mentioned above, will be described.

Figure 19:
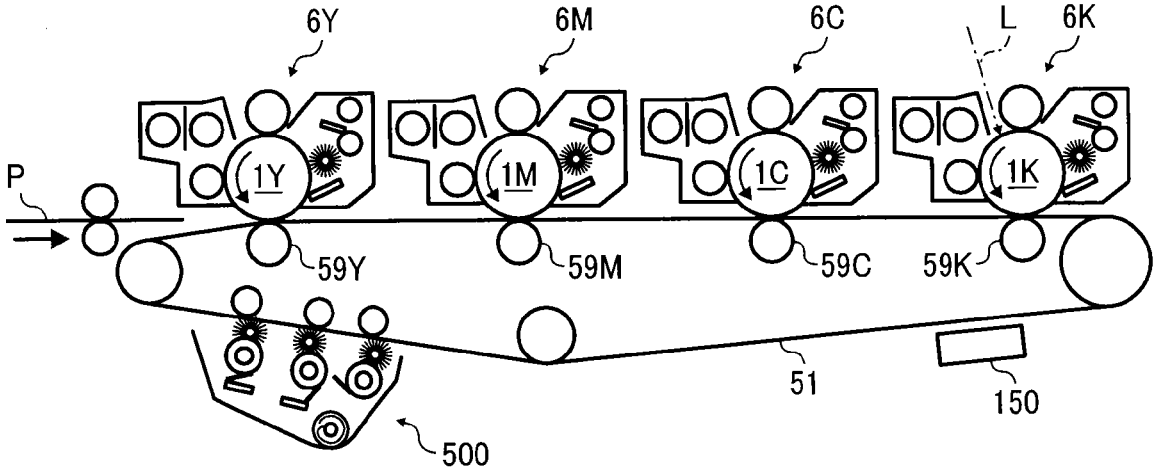
FIG. 19 is a schematic view illustrating the main portion of a tandem type direct transfer color printer as another example of the image forming apparatus.

The belt cleaner 100 described in the first embodiment is not limited to a cleaner to clean the front surface of an intermediate transfer belt, and can be used for such a recording medium feeding belt cleaner 500 (hereinafter referred to as a feeding belt cleaner) as illustrated in FIG. 19.

FIG. 19 illustrates a direct transfer type tandem printer. In the printer illustrated in FIG. 19, a recording medium feeding belt 51 (hereinafter referred to as a feeding belt), which feeds the recording medium P and which is a member to be cleaned, is contacted with the photoreceptors 1Y, 1M, 1C and 1K of the image forming units 6Y, 6M, 6C and 6K by four primary transfer rollers 59Y, 59M, 59C and 59K, respectively, to form Y, M, C and K primary transfer nips at which Y, M, C and K toner images are transferred. The feeding belt 51 feeds the recording medium P from left to right so that the recording medium P passes through the Y, M, C and K primary transfer nips in this order, resulting in transferring of the Y, M, C and K toner images onto the recording medium P. After the K toner image on the photoreceptor 1K is primarily transferred onto the recording medium P, foreign materials such as toner particles on the feeding belt 51 are removed therefrom by the feeding belt cleaner 500. In the printer, the optical sensor unit 150 is provided so as to be opposed to the outer surface of the feeding belt 51 with a predetermined distance.

In the printer illustrated in FIG. 19, the image density control and the misalignment correction mentioned above are performed at a predetermined time. Specifically, a patterned toner image (such as half tone pattern and chevron patch) is formed on the feeding belt 51, and the patterned toner image is detected by the optical sensor unit 150, followed by performing the correction operations based on the detection results. After the detection operation, the patterned toner image is removed from the feeding belt 51 by the feeding belt cleaner 500. Thus, the feeding belt 51 also serves as a toner image carrier.

By using the cleaner of this disclosure for the feeding belt cleaner 500, the feeding belt 51 can be maintained in a satisfactorily cleaned state over a long period of time.

The present application is not limited to the above-mentioned embodiments. The present application includes the below-mentioned embodiments, which produce the below-mentioned specific effects.

Embodiment 1

The cleaner of Embodiment 1 includes a first cleaning brush roller 101 which serves as a cleaning member to electrostatically remove toner which is charged with a first polarity and which is located on a rotatable intermediate transfer belt 8 to be cleaned; a cleaning power source 131 to supply a first voltage or a first current having a polarity opposite to the first polarity to the first cleaning brush roller 101; a toner collecting roller 102 serving as a collecting member to collect the toner from the cleaning brush roller 101; and a toner collecting power source 132 to supply a second voltage or a second current, which has the first polarity and whose absolute value is greater than that of the first voltage or current, to the toner collecting roller 102. The cleaning power source 131 includes a power output member 131*b* serving as a first output member to output the first voltage or current to the cleaning brush roller 101, and a power control member 131*a* serving as a first control member to output a first control signal 131*d* to the power output member 131*b* to set the value of the first voltage or current output by the power output member 131*b*. The toner collecting power source 132 includes a power source output member 132*b* serving as a second output member to output the second voltage or current to the toner collecting roller 102, and a power control member 132*a* serving as a second control member to output a second control signal 132*d* to the power output member 132*b* to set the value of the second voltage or current output by the power output member 132*b*. The cleaning power source 131 sets plural levels of setting values for the first voltage or current, which are smaller than the targeted final value of the first voltage or current at which a desired electrostatic force can be generated on the cleaning brush roller 101, and the power control member 131*a* changes the first control signal in a step-by-step manner so that the first voltage or current output from the power output member 131*b* is changed in a step-by-step manner based on the plural levels of setting values before the first voltage or current reaches the targeted final first voltage or current. In addition, the toner collecting power source 132 sets plural levels of setting values for the second voltage or current, which are smaller than the targeted final value of the second voltage or current at which a desired electrostatic force can be generated on the toner collecting roller 102, and the power control member 132*a* changes the second control signal in a step-by-step manner so that the second voltage or current output from the power output member 132*b* is changed in a step-by-step manner based on the plural levels of setting values before the second voltage or current reaches the targeted final second voltage or current.

In this cleaner, the control signals concerning the voltages or currents supplied to the cleaning member and the collecting member are changed in a step-by-step manner, and therefore the change in voltage or current can be decreased so as to be relatively small compared with conventional cleaners in which the voltage or current is changed to the targeted final voltage or current in one step using only one control signal. As a result, even when the time, at which the voltage or current reaches the firstly set voltage or current after the power source is activated, or the time, at which the voltage or current is changed from a set voltage or current to the next voltage or current, varies due to the individual difference of the power source, occurrence of the defective activation problem can be prevented. Specifically, even in a case in which the power sources themselves have the individual difference, by changing the control signals in a step-by-step manner, the difference in voltage or current can be controlled so as to be not greater than the difference between two intermediate values of the setting values for the first and second voltages or currents. Therefore, the maximum potential difference can be decreased so as to be not greater than the potential difference caused by the difference between the two intermediate voltages or currents. In this regard, by properly setting the plural levels of setting values for the first and second voltages or currents such that when the inflow current generated due to the potential difference flows into the power sources, the power sources do not cause the defective activation problem, it becomes possible to prevent occurrence of the defective activation problem due to interference between the power sources without increasing costs of the cleaner.

Embodiment 2

Embodiment 2 has a configuration such that in addition to the configuration of Embodiment 1 mentioned above, the time period of one step of the first control signal 131*d* is set such that the current flowing from the first cleaning brush roller 101 to the first toner collecting roller 102 is not greater than the guaranteed maximum inflowing current below which the second power output member 132*b* can be securely activated. In addition, the time period of one step of the second control signal 132*d* is set such that the current flowing from the first toner collecting roller 102 to the first cleaning brush roller 101 is not greater than the guaranteed maximum inflowing current below which the first power output member 131*b* can be securely activated.

In this cleaner, as described above by reference to Example 1 of the first embodiment, even when only the second voltage is applied to the first toner collecting roller 102 by the power output member 132*b* of the toner collecting power source 132, the cleaning power source 131 does not cause the defective activation problem. In addition, even when only the first voltage is applied to the first cleaning brush roller 101 by the power output member 131*b* of the cleaning power source 131, the toner collecting power source 132 does not cause the defective activation problem. Therefore, the output from the power output member based on the first control signal can securely reach the targeted final first voltage or current, and the output from the power output member based on the second control signal can securely reach the targeted final second voltage or current.

Embodiment 3

Embodiment 3 has a configuration such that in addition to the configuration of Embodiment 2 mentioned above, the switching time (i.e., the time period of one step) of the first control signal 131*d* in the step-by-step voltage or current changing operation is not greater than the predetermined time period in which the voltage or current output from the power output member 131*b* of the cleaning power source 131 reaches the targeted intermediate voltage or current in the step, and the switching time of the second control signal 132*d* in the step-by-step voltage or current changing operation is not greater than the predetermined time period in which the voltage or current output from the power output member 132*b* of the toner collecting power source 131 reaches the targeted intermediate voltage or current in the step.

In this cleaner, as described above by reference to Example 1 of the first embodiment, the time period in which the first voltage or current output from the power output member based on the first control signal reaches the targeted final first voltage or current can be shortened while the time period in which the second voltage or current output from the power output member based on the second control signal reaches the targeted final second voltage or current can be shortened.

Embodiment 4

Embodiment 4 has a configuration such that in addition to the configuration of any one of Embodiments 1 to 3, formation of the desired electrostatic force is performed on the first toner collecting roller 102 prior to formation of the desired electrostatic force on the first cleaning brush roller 101.

The voltage applied to the first toner collecting roller 102 is typically higher than the voltage applied to the first cleaning brush roller 101 so that the first toner collecting roller can collect the toner from the first cleaning brush roller. Therefore, in the cleaner of Embodiment 4, when the cleaner is activated, the potential of the first toner collecting roller 102 is allowed to be higher than that of the first cleaning brush roller 101 so that the toner remaining on the first cleaning brush roller can be collected and the cleaning performance of the first cleaning brush roller can be enhanced. This is described above by reference to Example 2 of the first embodiment, Embodiment 5

Embodiment 5 has a configuration such that in addition to the configuration of any one of Embodiments 1 to 4, plural cleaning units each including the cleaning brush roller and the toner collecting roller are arranged side by side in the rotation direction of a member to be cleaned (such as the intermediate transfer belt). In each of the cleaning power sources of the cleaning units, the first control signal is changed in a step-by-step manner so that the first voltage or current output from the power output member is changed in a step-by-step manner (i.e., changed to have intermediate first voltages or currents) before the first voltage or current reaches the targeted final first voltage or current, by which the desired electrostatic force is formed on the cleaning brush roller, while the plural cleaning units perform the change in synchronization with each other. In addition, the second control signal is changed in a step-by-step manner so that the second voltage or current output from the power output member is changed in a step-by-step manner (i.e., changed to have intermediate second voltages or currents) before the second voltage or current reaches the targeted final second voltage or current, by which the desired electrostatic force is formed on the toner collecting roller, while the plural cleaning units perform the change in synchronization with each other.

In this cleaner, as described above by reference to Example 3 of the first embodiment, occurrence of phenomena in that the first voltage or current output from the power output member of one of the cleaning units based on the first control signal output from the power control member of the cleaning unit reaches the targeted final first voltage or current prior to the first voltages or currents output from the power output members of the other cleaning units; and the second voltage or current output from the power output member of one of the cleaning units based on the second control signal output from the power control member of the cleaning unit reaches the targeted final second voltage or current prior to the second voltages or currents output from the power output members of the other cleaning units can be prevented.

Therefore, a phenomenon such that an inflowing current flows from the one of the cleaning units into the other cleaning units depending on the targeted final first voltage or current or the targeted final second voltage or current can be prevented, thereby making it possible to prevent occurrence of the defective activation problem of the power sources due to interference between the power sources.

Embodiment 6

Embodiment 6 has a configuration such that in addition to the configuration of Embodiment 5, when the desired electrostatic force is formed on the cleaning brush roller or the toner collecting roller of one of the cleaning units, the first control signal is changed in the other cleaning units so that the first voltage or current reaches the targeted final first voltage or current or the second control signal, or the second control signal is changed in the other cleaning units so that the second voltage or current reaches the targeted final second voltage or current.

In this cleaner, as described above by reference to Example 4 of the first embodiment, at a time in which the first voltage or current output from the power output member of one of the cleaning units, which are operated in synchronization with each other, reaches the targeted final first voltage or current, the first voltages or currents output from the power output members of the other cleaning units are gradually changed toward the targeted final first voltage or current. In this case, even when the first voltages or currents output from the power output members of the other cleaning units are continuously changed so as to reach the targeted final first voltage or current, the potential difference between the first voltage and the second voltage is relatively small compared with that in conventional cleaners. Therefore, the inflowing current is not greater than the predetermined value, and the power sources can be securely activated. Namely, it is not necessary to provide a circuit to securely activate the power sources even when an inflowing current flows, resulting in reduction of costs of the power sources.

Embodiment 7

The image forming apparatus of Embodiment 7 includes an image carrier; a toner image forming device to form a toner image on a surface of the image carrier; and a cleaner to remove residual toner from the surface of the image carrier, wherein the cleaner is the cleaner mentioned above in any one of Embodiments 1 to 6. Since the cleaner of the image forming apparatus can maintain good cleanability as mentioned above in the first embodiment, the image forming apparatus can produce good images.

Embodiment 8

The image forming apparatus of Embodiment 8 includes an image carrier; a toner image forming device to form a toner image on a surface of the image carrier; a primary transferring device to transfer the toner image onto an intermediate transfer medium; a secondary transferring device to transfer the toner image on the intermediate transfer medium to a recording medium; and a cleaner to remove residual toner from the surface of the intermediate transfer medium. The cleaner is the cleaner mentioned above in any one of Embodiment 1 to 6. Since the cleaner of the image forming apparatus can maintain good cleanability as mentioned above in the first embodiment, the image forming apparatus can produce good images.

Embodiment 9

The image forming apparatus of Embodiment 9 includes an image carrier; a toner image forming device to form a toner image on a surface of the image bearing member; a transferring device to transfer the toner image onto a recording medium at a transfer position; a recording medium feeder to feed the recording medium to the transfer position; and a cleaner to remove residual toner on the surface of the recording medium feeder. The cleaner is the cleaner mentioned above in any one of Embodiments 1 to 6. Since the cleaner of the image forming apparatus can maintain good cleanability as mentioned above in the second embodiment, the image forming apparatus can produce good images.

Embodiment 10

In any one of Embodiments 7 to 9, when abnormal image formation is caused (e.g., when the sensor 160 and the controller 170 detect jamming of the recording medium), each of the number of the setting values of the first voltage or current set by the cleaning power source, and the number of the setting values of the second voltage or current set by the toner cleaning power source is reduced.

As mentioned above in the first embodiment, when abnormal image formation is caused (e.g., when jamming of the recording medium occurs), a large amount of non-transferred toner is present on the intermediate transfer belt, and therefore it is desired to quickly remove the non-transferred toner using the cleaner. In such a case, it is preferable to quickly activate the cleaner while preventing generation of an inflowing current. Therefore, in Embodiment 10, each of the number of the setting values of the first voltage or current set by the cleaning power source 131, and the number of the setting values of the second voltage or current set by the toner cleaning power source 132 is reduced so that the first voltage or current output from the power output member 131*b* of the cleaning power source 131 quickly reaches the targeted first voltage or current, and the second voltage or current output from the power output member 132*b* of the toner collecting power source 132 quickly reaches the targeted second voltage or current. By using this technique, the cleaning operation can be quickly performed after the cleaner is activated without generating an inflowing current and causing the defective activation problem in that the power sources are defectively activated due to interference therebetween.

Additional modifications and variations of the present invention are possible in light of the above teachings. It is therefore to be understood that within the scope of the appended claims the invention may be practiced other than as specifically described herein.

What is claimed is:

1. A cleaner comprising:

at least one cleaning unit including:

a cleaning member to electrostatically remove toner which is charged with a first polarity and which is located on a rotatable object to be cleaned;

a first power supply to apply a first voltage or current with a second polarity opposite to the first polarity to the cleaning member so that the cleaning member electrostatically attracts the toner on the rotatable object;

a toner collecting member to collect the toner from the cleaning member; and a second power supply to apply a second voltage or current, which has the second polarity and which is greater than the first voltage or current in absolute value, to the toner collecting member so that the toner collecting member electrostatically attracts the toner on the cleaning member, wherein the first power supply includes:

a first output to output the first voltage or current to the cleaning member to form a predetermined electrostatic force on the cleaning member; and a first controller to output a first control signal to the first output so that the first output outputs the first voltage or current based on the first control signal, wherein the second power supply includes:

a second output to output the second voltage or current to the toner collecting member to form a predetermined electrostatic force on the toner collecting member; and a second controller to output a second control signal to the second output so that the second output outputs the second voltage or current based on the second control signal, wherein the first power supply sets plural setting values of the first voltage or current, which are not greater than a targeted final value of the first voltage or current, and whenever the first voltage or current is applied to the cleaning member to clean the cleaning member, the first controller changes the first control signal in a step-by-step manner so that the first output applies the first voltage or current while changing the first voltage or current in a step-by-step manner based on the plural setting values before the first voltage or current reaches the targeted final value of the first voltage or current, and wherein the second power supply sets plural setting values of the second voltage or current, which are not greater than a targeted final value of the second voltage or current, and whenever the second voltage or current is applied to the toner collecting member to clean the toner collecting member, the second controller changes the second control signal in a step-by-step manner so that the second output applies the second voltage or current while changing the second voltage or current in a step-by-step manner based on the plural setting values before the second voltage or current reaches the targeted final value of the second voltage or current.

2. The cleaner according to claim 1, wherein the first controller changes the first control signal from a step to a next step in such a manner that a current flowing from the cleaning member to the toner collecting member is not greater than a guaranteed maximum inflowing current of the second output below which the second output can be securely activated, and the second controller changes the second control signal from a step to a next step in such a manner that a current flowing from the toner collecting member to the cleaning member is not greater than a guaranteed maximum inflowing current of the first output below which the first output can be securely activated.

3. The cleaner according to claim 2, wherein a time period of a step of the first control signal changed in the step-by-step manner is not greater than a predetermined time period in which the voltage or current output from the first output of the first power supply reaches a targeted intermediate value of the first voltage or current in the step, and a time period of a step of the second control signal changed in the step-by-step manner is not greater than a predetermined time period in which the voltage or current output from the second output of the second power supply reaches a targeted intermediate value of the second voltage or current in the step.

4. The cleaner according to claim 1, wherein the second output forms the predetermined electrostatic force on the toner collecting member before the first output forms the predetermined electrostatic force on the cleaning member.

5. The cleaner according to claim 1, including plural cleaning units each having a corresponding cleaning member, first power supply having a first output and first controller, toner collecting member, second power supply having a second output and second controller, the plural cleaning units being side by side in a rotation direction of the rotatable object to be cleaned, wherein the first control signals output from the first controllers of the plural cleaning units are changed in the step-by-step manner while substantially synchronized with each other in the plural cleaning units so that the first voltages or currents output from the first outputs are changed in the step-by-step manner while substantially synchronized with each other in the plural cleaning units, and wherein the second control signals output from the second controllers of the plural cleaning units are changed in the step-by-step manner while substantially synchronized with each other in the plural cleaning units so that the second voltages or currents output from the second outputs are changed in the step-by-step manner while substantially synchronized with each other in the plural cleaning units.

6. The cleaner according to claim 5, wherein when the predetermined electrostatic force is formed on at least one of the cleaning member and the toner collecting member of one of the plural cleaning units, the first controllers of the other cleaning units change the first control signals so that the first voltages or currents reach the targeted final values of the first voltages or currents, and the second controllers of the other cleaning units change the second control signals so that the second voltages or currents reach the targeted final values of the second voltages or currents.

7. An image forming apparatus comprising:

an image carrier;

a toner image forming device to form a toner image on a surface of the image carrier;

a transferring device to transfer the toner image on the image carrier to a recording medium, and the cleaner according to claim 1 to remove residual toner from the surface of the image carrier.

8. The image forming apparatus according to claim 7, further comprising:

a detector to detect the recording medium; and a controller to determine whether or not the recording medium jams based on a detection result of the detector, wherein when the controller determines that the recording medium jams, the first power supply reduces a number of the setting values of the first voltage or current, and the second power supply reduces a number of the setting values of the second voltage or current.

9. An image forming apparatus comprising:

an image carrier;

a toner image forming device to form a toner image on a surface of the image carrier;

a primary transferring device to transfer the toner image on the image carrier to an intermediate transfer medium;

a secondary transferring device to transfer the toner image on the intermediate transfer medium to a recording medium; and the cleaner according to claim 1 to remove residual toner from the surface of the intermediate transfer medium.

10. The image forming apparatus according to claim 9, further comprising:

a detector to detect the recording medium; and a controller to determine whether or not the recording medium jams based on a detection result of the detector, wherein when the controller determines that the recording medium jams, the first power supply reduces a number of the setting values of the first voltage or current, and the second power supply reduces a number of the setting values of the second voltage or current.

11. An image forming apparatus comprising:

an image carrier;

a toner image forming device to form a toner image on a surface of the image carrier;

a transferring device to transfer the toner image on the image carrier to a recording medium at a transfer position;

a recording medium feeder to feed the recording medium to the transfer position; and the cleaner according to claim 1 to remove residual toner on the surface of the recording medium feeder.

12. The image forming apparatus according to claim 11, further comprising:

a detector to detect the recording medium; and a controller to determine whether or not the recording medium jams based on a detection result of the detector, wherein when the controller determines that the recording medium jams, the first power supply reduces a number of the setting values of the first voltage or current, and the second power supply reduces a number of the setting values of the second voltage or current.

* * * * *